US008401721B2

(12) United States Patent
Nakamura et al.

(10) Patent No.: US 8,401,721 B2
(45) Date of Patent: Mar. 19, 2013

(54) VARIABLE VALVE ACTUATING APPARATUS, VALVE PHASE VARYING APPARATUS AND CONTROL APPARATUS FOR INTERNAL COMBUSTION ENGINE

(75) Inventors: Makoto Nakamura, Zushi (JP); Seinosuke Hara, Atsugi (JP); Tomoyuki Murakami, Chigasaki (JP); Toru Kitayama, Yokohama (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 298 days.

(21) Appl. No.: 12/960,912

(22) Filed: Dec. 6, 2010

(65) Prior Publication Data

US 2011/0137504 A1 Jun. 9, 2011

(30) Foreign Application Priority Data

Dec. 7, 2009 (JP) ..... 2009-277153

(51) Int. Cl.
*B60L 9/00* (2006.01)

(52) U.S. Cl. ..... 701/22

(58) Field of Classification Search ..... None
See application file for complete search history.

(56) References Cited

FOREIGN PATENT DOCUMENTS

JP 2002-295274 A 10/2002
JP 2003-172112 A 6/2003

*Primary Examiner* — Thomas Tarcza
*Assistant Examiner* — Adam Alharbi
(74) *Attorney, Agent, or Firm* — Crowell & Moring LLP

(57) ABSTRACT

An internal combustion engine is provided with a valve lift varying mechanism for intake valves and a valve phase varying mechanism for exhaust valves. A controller performs a control operation in response to a request to pause at least one cylinder while the engine is in operation. The control operation includes: a first operation of setting an intake valve lift to a zero-lift setpoint by the valve lift varying mechanism; and a second operation of setting an exhaust valve phase by the valve phase varying mechanism so as to set an exhaust valve opening timing to a first timing setpoint on an advance side of bottom dead center and set an exhaust valve closing timing to a second timing setpoint on a retard side of bottom dead center. The first and second timing setpoints are closer to top dead center than to bottom dead center.

21 Claims, 15 Drawing Sheets

VARIABLE VALVE ACTUATING APPARATUS, VALVE PHASE VARYING APPARATUS AND CONTROL APPARATUS FOR INTERNAL COMBUSTION ENGINE

BACKGROUND OF THE INVENTION

The present invention relates to variable valve actuating apparatus or system, valve phase varying apparatus and control apparatus for internal combustion engine.

Japanese Patent Application Publication No. 2002-295274 discloses a variable valve actuating system for an internal combustion engine. This variable valve actuating system is configured to shift into a mode called pseudo cylinder pause mode, when the internal combustion engine shifts into low load state or decelerating state. In this mode, the variable valve actuating system sets intake valve lift to a zero-lift setpoint, sets exhaust valve lift to a non-zero minimum lift setpoint, and sets exhaust valve phase so that exhaust valve lift peaks at or close to bottom dead center. This operation is intended for reducing pumping loss.

SUMMARY OF THE INVENTION

It is desirable to provide a variable valve actuating apparatus or system, a valve phase varying apparatus and a control apparatus for an internal combustion engine which are capable of executing such a pseudo cylinder pause mode more quietly and smoothly, and executing a transition to the pseudo cylinder pause mode more quietly and smoothly.

According to one aspect of the present invention, a control apparatus is provided for an internal combustion engine, wherein: the internal combustion engine is provided with: a valve lift varying mechanism arranged to vary an intake valve lift of the internal combustion engine, and set the intake valve lift at least to a non-zero lift setpoint and to a zero-lift setpoint; and a valve phase varying mechanism arranged to vary an exhaust valve phase of the internal combustion engine; and the control apparatus comprises a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes: a first operation of setting the intake valve lift to the zero-lift setpoint by the valve lift varying mechanism; and a second operation of setting the exhaust valve phase by the valve phase varying mechanism so as to set an exhaust valve opening timing of the internal combustion engine to a first timing setpoint on an advance side of bottom dead center and set an exhaust valve closing timing of the internal combustion engine to a second timing setpoint on a retard side of bottom dead center, wherein the first and second timing setpoints are closer to top dead center than to bottom dead center. The first timing setpoint may be substantially as close to bottom dead center as the second timing setpoint. The first timing setpoint may be closer to bottom dead center than the second timing setpoint. The controller may be configured to: set the first timing setpoint substantially as close to bottom dead center as the second timing setpoint in response to determination that the internal combustion engine is rotating below a predetermined speed setpoint; and set the first timing setpoint closer to bottom dead center than the second timing setpoint in response to determination that the internal combustion engine is rotating above the predetermined speed setpoint. The controller may be configured to perform the control operation for at least part of cylinders of the internal combustion engine in response to determination that a vehicle provided with the internal combustion engine is decelerating under a predetermined condition. The controller may be configured to perform the control operation for part of cylinders of the internal combustion engine in response to determination that the internal combustion engine is operating in a predetermined low load region. The control apparatus may be configured so that: a vehicle is provided with the internal combustion engine and an electric motor for driving the vehicle; and the controller is configured to perform the control operation for all cylinders of the internal combustion engine in response to determination that the internal combustion engine is operating in a predetermined low load region. The control apparatus may be configured so that: a vehicle is provided with the internal combustion engine and an electric motor for producing driving torque to drive the vehicle; and the control operation includes a third operation of controlling the electric motor so as to cancel transient change in the driving torque during the control operation. The second operation may be implemented by maximally advancing the exhaust valve phase by the valve phase varying mechanism.

According to another aspect of the present invention, a control apparatus is provided for an internal combustion engine, wherein: the internal combustion engine is provided with: a valve lift varying mechanism arranged to vary an intake valve lift of the internal combustion engine, and set the intake valve lift at least to a non-zero lift setpoint and to a zero-lift setpoint; and a valve phase varying mechanism arranged to vary an exhaust valve phase of the internal combustion engine; and the control apparatus comprises a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes: a first operation of setting the intake valve lift to the zero-lift setpoint by the valve lift varying mechanism; and a second operation of setting the exhaust valve phase by the valve phase varying mechanism after the first operation so as to set an exhaust valve opening timing of the internal combustion engine to a first timing setpoint on an advance side of bottom dead center and set an exhaust valve closing timing of the internal combustion engine to a second timing setpoint on a retard side of bottom dead center. The first timing setpoint may be closer to bottom dead center than the second timing setpoint. The controller may be configured to: set the first timing setpoint substantially as close to bottom dead center as the second timing setpoint in response to determination that the internal combustion engine is rotating below a predetermined speed setpoint; and set the first timing setpoint closer to bottom dead center than the second timing setpoint in response to determination that the internal combustion engine is rotating above the predetermined speed setpoint. The controller may be configured to perform the control operation for at least part of cylinders of the internal combustion engine in response to determination that a vehicle provided with the internal combustion engine is decelerating under a predetermined condition. The control apparatus may be configured so that: a vehicle is provided with the internal combustion engine and an electric motor for producing driving torque to drive the vehicle; and the control operation includes a third operation of controlling the electric motor so as to cancel transient change in the driving torque during the control operation. The second operation may be implemented by maximally advancing the exhaust valve phase by the valve phase varying mechanism.

According to a further aspect of the present invention, a valve phase varying apparatus is provided for an internal combustion engine, wherein: the internal combustion engine is provided with a valve lift varying mechanism, wherein the valve lift varying mechanism is arranged to vary an intake valve lift of the internal combustion engine, and configured to set the intake valve lift to a zero-lift setpoint in response to a request to pause at least one cylinder of the internal combustion engine while the internal combustion engine is in operation; and the valve phase varying apparatus comprises a valve phase varying mechanism arranged to vary an exhaust valve phase of the internal combustion engine, wherein the valve phase varying mechanism allows the exhaust valve phase to be set so as to set an exhaust valve opening timing of the internal combustion engine to a first timing setpoint on an advance side of bottom dead center and set an exhaust valve closing timing of the internal combustion engine to a second timing setpoint on a retard side of bottom dead center, wherein the first and second timing setpoints are closer to top dead center than to bottom dead center. The valve phase varying apparatus may be configured so that the exhaust valve opening timing is at the first timing setpoint and the exhaust valve closing timing is at the second timing setpoint when the exhaust valve phase is at a maximally advanced setpoint allowed by the valve phase varying mechanism. The valve phase varying mechanism may be arranged to stabilize the exhaust valve phase at a setpoint on a retard side of the maximally advanced setpoint when the valve phase varying mechanism is in non-driven state.

According to a still further aspect of the present invention, a variable valve actuating apparatus is provided for an internal combustion engine, the variable valve actuating apparatus comprising: a valve lift varying mechanism arranged to vary an intake valve lift of the internal combustion engine, and set the intake valve lift at least to a non-zero lift setpoint and to a zero-lift setpoint; a valve phase varying mechanism arranged to vary an exhaust valve phase of the internal combustion engine; and a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes: a first operation of setting the intake valve lift to the zero-lift setpoint by the valve lift varying mechanism; and a second operation of setting the exhaust valve phase by the valve phase varying mechanism so as to set an exhaust valve opening timing of the internal combustion engine to a first timing setpoint on an advance side of bottom dead center and set an exhaust valve closing timing of the internal combustion engine to a second timing setpoint on a retard side of bottom dead center, wherein the first and second timing setpoints are closer to top dead center than to bottom dead center. The valve lift varying mechanism may be arranged to stabilize the intake valve lift at the non-zero lift setpoint when the valve lift varying mechanism is in non-driven state.

According to another aspect of the present invention, a variable valve actuating apparatus is provided for an internal combustion engine, the variable valve actuating apparatus comprising: a valve lift varying mechanism arranged to vary an intake valve lift of the internal combustion engine, and set the intake valve lift at least to a non-zero lift setpoint and to a zero-lift setpoint; a valve phase varying mechanism arranged to vary an exhaust valve phase of the internal combustion engine; and a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes: a first operation of setting the intake valve lift to the zero-lift setpoint by the valve lift varying mechanism; and a second operation of setting the exhaust valve phase by the valve phase varying mechanism after the first operation so as to set an exhaust valve opening timing of the internal combustion engine to a first timing setpoint on an advance side of bottom dead center and set an exhaust valve closing timing of the internal combustion engine to a second timing setpoint on a retard side of bottom dead center.

DETAILED DESCRIPTION OF THE INVENTION

Figure 1:
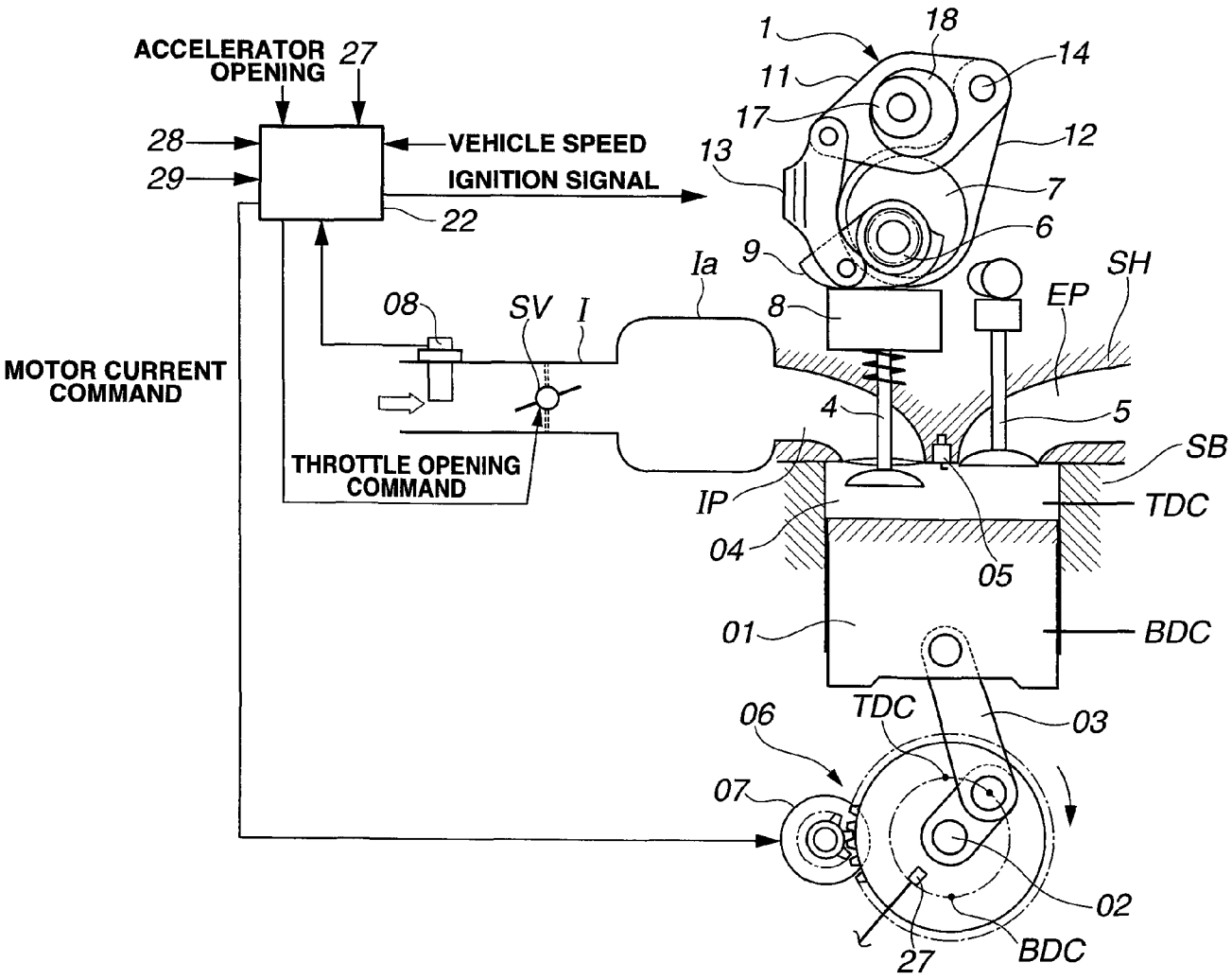
FIG. 1 is a schematic diagram showing an internal combustion engine system including a variable valve actuating apparatus or system according to first and second embodiments of the present invention.

FIG. 1 schematically shows an internal combustion engine system including a variable valve actuating system or apparatus according to first and second embodiments of the present invention. In these embodiments, the internal combustion engine system includes a four-cycle multi-cylinder spark-ignition internal combustion engine whose intake side and exhaust side are adapted to the variable valve actuating system. As shown in FIG. 1, the engine includes a cylinder block "SB", a cylinder head "SH", a piston 01 per cylinder, a pair of intake valves 4, 4 per cylinder, and a pair of exhaust valves 5, 5 per cylinder. Piston 01 is slidably mounted in a cylinder bore formed in cylinder block SB so that piston 01 moves upward and downward in the longitudinal direction of the cylinder bore. Cylinder head SH is formed with an intake port "IP" and an exhaust port "EP" per cylinder. Each intake valve 4 is slidably mounted in cylinder head SH, and arranged to open and close an opening end of intake port IP. Similarly, each exhaust valve 5 is slidably mounted in cylinder head SH, and arranged to open and close an opening end of exhaust port EP.

Piston 01 is linked to a crankshaft 02 through a connecting rod 03, defining a combustion chamber 04 between the crown of piston 01 and a lower surface of cylinder head SH.

Intake port IP is connected to an intake manifold "Ia" of an intake pipe "I". Intake pipe I is provided with a throttle valve "SV" that is disposed upstream of intake manifold Ia, and arranged to regulate the amount of intake air. Downstream of intake manifold Ia is provided a fuel injection valve not shown. Each cylinder is provided with an ignition plug 05 substantially at the center of the upper side of combustion chamber 04 or the lower surface of cylinder head SH.

Crankshaft 02 is adapted to be driven not only by the engine, but also by an electric motor 07 through a pinion gear mechanism 06. Electric motor 07 is used not only as a starter motor, but also as a means for allowing regenerative braking when the vehicle is decelerating, and charging a battery not shown with regenerated power.

Figure 2:
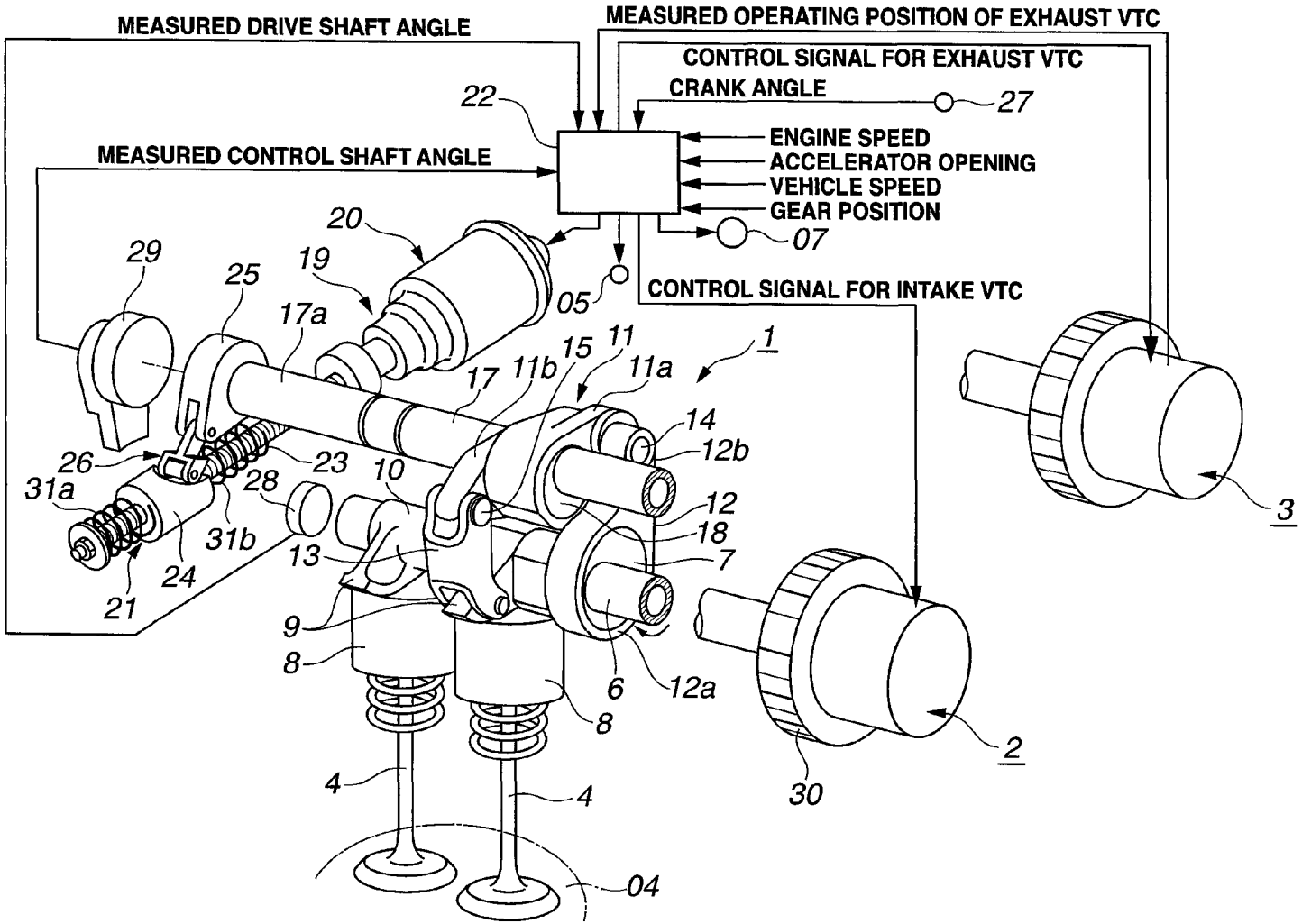
FIG. 2 is a schematic diagram showing a perspective view of a valve lift varying mechanism, an intake valve phase varying mechanism, and an exhaust valve phase varying mechanism in the variable valve actuating system.

As shown in FIGS. 1 and 2, the variable valve actuating system includes a valve lift varying mechanism (valve operating angle varying mechanism, valve event and lift varying mechanism, or VEL) 1 for continuously varying (increasing or reducing) the lift and operating angle (operating period, or period when a valve is open) of intake valves 4, and an intake valve phase varying mechanism (intake valve timing varying mechanism, intake valve timing control mechanism, or intake VTC) 2 for continuously varying (advancing or retarding) the phase (initial phase, lift phase, lift central phase, or lift peak phase) of intake valves 4 so as to vary (advance or retard) the opening and closing timings of intake valves 4 (intake valve opening timing IVO and intake valve closing timing IVC), while holding constant the operating angle of intake valves 4. The variable valve actuating system further includes an exhaust valve phase varying mechanism (exhaust valve timing varying mechanism, exhaust valve timing control mechanism, or exhaust VTC) 3 for continuously varying (advancing or retarding) the phase (initial phase, lift phase, lift central phase, or lift peak phase) of exhaust valves 5 so as to vary (advance or retard) the opening and closing timings of exhaust valves 5 (exhaust valve opening timing EVO and exhaust valve closing timing EVC), while holding constant the operating angle of exhaust valves 5. Operation of valve lift varying mechanism 1, intake valve phase varying mechanism 2, and exhaust valve phase varying mechanism 3 is controlled by a common control apparatus or controller 22 according to engine operating state, as described in detail below.

Figure 3A:
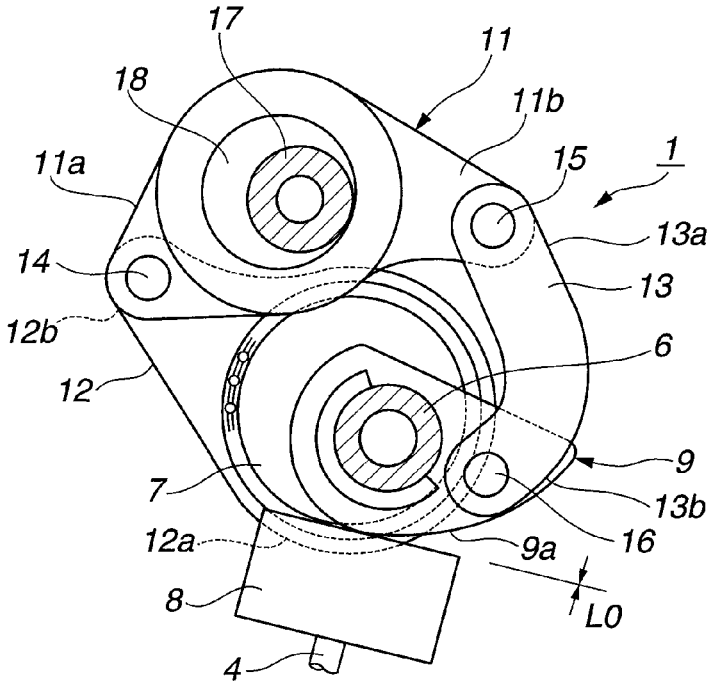
FIGS. 3A and 3B are diagrams illustrating how the valve lift varying mechanism operates when controlled to be in a state of zero lift.

Valve lift varying mechanism 1 has a construction as disclosed in Japanese Patent Application Publication No. 2003-172112. As shown in FIGS. 2 and 3A, valve lift varying mechanism 1 includes a hollow drive shaft 6 which is rotatably supported by bearings on an upper part of cylinder head SH; a drive cam 7 which is an eccentric rotary cam fixedly mounted on drive shaft 6 by press fitting in this example; a pair of swing cams 9 which are swingably mounted on drive shaft 6, and arranged to open the intake valves 4, respectively, by sliding on top surfaces of valve lifters 8 provided in the upper ends of intake valves 4; and a linkage or motion transmitting mechanism arranged to transmit rotation of drive cam 7 to swing cams 9 for swing motion.

Drive shaft 6 is arranged to receive rotation from crankshaft 02 through a rotation transmitting mechanism which, in this example, is a chain drive including a timing sprocket 30 provided on one end of drive shaft 6, a driving sprocket provided on crankshaft 02, and a timing chain not shown. When driven by crankshaft 02, the drive shaft 6 rotates in a clockwise direction as viewed in FIG. 2 and shown by an arrow in FIG. 2.

Drive cam 7 is shaped like a ring, and formed with a drive shaft receiving hole extending in the axial direction of drive cam 7. Drive cam 7 is fixedly mounted on drive shaft 6 extending through the drive shaft receiving hole. The axis of drive cam 7 is offset in the radial direction from the axis of drive shaft 6 by a predetermined distance.

As shown in FIGS. 2 and 3A, swing cams 9 are formed integrally at both ends of an annular camshaft 10. Each swing cam 9 is in the same raindrop form. Camshaft 10 is hollow and rotatably mounted on drive shaft 6. Each swing cam 9 has a lower surface including a cam surface 9*a*. Cam surface 9*a* includes a base circle surface region on the cam shaft's side, a ramp surface region extending like a circular arc from the base circle surface region toward a cam nose, and a lift surface region extending from the ramp surface region toward an apex of the cam nose. The cam surface 9*a* abuts on the top surface of the corresponding valve lifter 8 at a predetermined position, and the contact point of the cam surface 9*a* shifts among the base circle surface region, ramp surface region and lift surface region in dependence on the swing position of the swing cam 9.

The above-mentioned linkage or motion transmitting mechanism includes a rocker arm 11 disposed above drive shaft 6; a link arm 12 connecting a first end portion 11*a* of rocker arm 11 with drive cam 7; and a link rod 13 connecting a second end portion 11*b* of rocker arm 11 with one swing cam 9.

Rocker arm 11 includes a tubular central base portion formed with a support hole, and rotatably mounted on a control cam 18 through the support hole. The first end portion 11*a* of rocker arm 11 is connected rotatably with link arm 12 by a pin 14, and the second end portion 11*b* is connected rotatably with a first end portion 13*a* of link rod 13 by a pin 15.

Link arm 12 includes a relatively large annular base portion 12*a* and a projection 12*b* projecting outward from the base portion 12*a*. Base portion 12*a* is formed with a center hole in which the cam portion of the drive cam 7 is rotatably fit. The projection 12*b* is connected rotatably with the first end portion 11*a* of rocker arm 11 by pin 14.

Link rod 13 includes a second end 13*b* which is connected rotatably with the cam nose of swing cam 9 by a pin 16.

Control shaft 17 extends in parallel to drive shaft 6 in the longitudinal direction of the engine, and is rotatably supported by the same bearings at a position just above drive shaft 6. Control cam 18 is fixedly mounted on control shaft 17 and fit slidably in the support hole of rocker arm 11 to serve as a fulcrum for the swing motion of rocker arm 11. Control cam 18 is shaped like a hollow cylinder, and the axis of control cam 18 is offset from the axis of the control shaft 17 by a predetermined distance. Rotation of control shaft 17 is controlled by a drive mechanism 19.

Drive mechanism 19 includes an electric motor 20 which is fixed to one end of a housing not shown; and a transmission mechanism 21 to transmit rotation of the electric motor 20 to the control shaft 17. In this example, the transmission mechanism 21 is a ball screw transmission mechanism.

Electric motor 20 of this example is a proportional type DC motor. Electric motor 20 is controlled by controller 22 in accordance with a measured operating state of the engine.

Ball screw transmission mechanism 21 includes a ball screw shaft 23, a ball nut 24, a connection arm 25 and a link member 26. Ball screw shaft 23 and the drive shaft of electric motor 20 are arranged end to end and aligned with each other so that their axes form a substantially straight line. Ball nut 24 serves as a movable nut screwed on the ball screw shaft 23 and arranged to move axially in accordance with the rotation. Connection arm 25 is connected with one end portion of control shaft 17. Link member 26 links the connection arm 25 and ball nut 24.

Ball screw shaft 23 is formed with an external continuous ball circulating groove that extends in the form of a helical thread over the entire outside surface of ball screw shaft 23 except both end portions. Ball screw shaft 23 and the drive shaft of electric motor 20 are connected end to end by a coupling member which transmits a rotational driving force from electric motor 20 to ball screw shaft 23. The coupling member allows ball screw shaft 23 to travel slightly in the axial direction of ball screw shaft 23. Ball nut 24 is approximately in the form of a hollow cylinder. Ball nut 24 is formed with an internal guide groove designed to hold a plurality of balls in cooperation with the ball circulating groove of ball screw shaft 23 so that the balls can roll between the guide groove and the circulating groove. This guide groove is a continuous helical thread formed in the inside circumferential surface of ball nut 24. Ball nut 24 is arranged to translate the rotation of ball screw shaft 23 into a linear motion of ball nut 24 and produce an axial force.

Ball screw transmission mechanism 21 is provided with first and second bias springs 31*a* and 31*b* around ball screw shaft 23, wherein ball nut 24 is arranged between first and second bias springs 31*a* and 31*b*. First bias spring 31*a* biases ball nut 24 axially toward electric motor 20, whereas second bias spring 31*b* biases ball nut 24 axially away from electric motor 20. It is to be understood from the following description that first bias spring 31*a* serves to bias the ball nut 24 in the direction to reduce the lift and operating angle of intake valves 4 toward a zero-lift setpoint, and second bias spring 31*b* serves to bias the ball nut 24 in the direction to increase the lift and operating angle of intake valves 4 toward a maximum lift setpoint (see L3 in FIG. 5). Accordingly, when the engine is stopped or at rest, then ball nut 24 is mechanically or elastically held in a medium lift setpoint (see L2 in FIG. 5) by the biasing forces of first and second bias springs 31*a* and 31*b* without power supply from the internal combustion engine, wherein the medium lift setpoint is suitable for engine start in general. Valve lift varying mechanism 1 is thus arranged to stabilize the intake valve lift at the non-zero lift setpoint when valve lift varying mechanism 1 is in non-driven state.

Controller 22 of this example is a common control unit or control section that is connected for signal communication therewith to valve lift varying mechanism 1, intake valve phase varying mechanism 2, and exhaust valve phase varying mechanism 3, and used for controlling all of them. Controller 22 is connected with various sensors to collect information on an operating state of the engine. Controller 22 receives data signals outputted from the sensors, and identifies the engine operating state on the basis of the data signals. The sensors include a crank angle sensor 27 for sensing the crank angle of crankshaft 02, and engine speed, an air flow meter for sensing the engine load, an accelerator opening sensor, a vehicle speed sensor, a gear position sensor, a drive shaft angle sensor 28 for sensing the rotation angle of drive shaft 6, and a control shaft angle sensor 29 for sensing the rotation angle of control shaft 17. Controller 22 measures the relative rotational position between timing sprocket 30 and drive shaft 6, and the lift and operating angle of intake valves 4, on the basis of the data signals from crank angle sensor 27, drive shaft angle sensor 28, and control shaft angle sensor 29. Controller 22 sends a control signal to drive motor 20.

Figure 5:
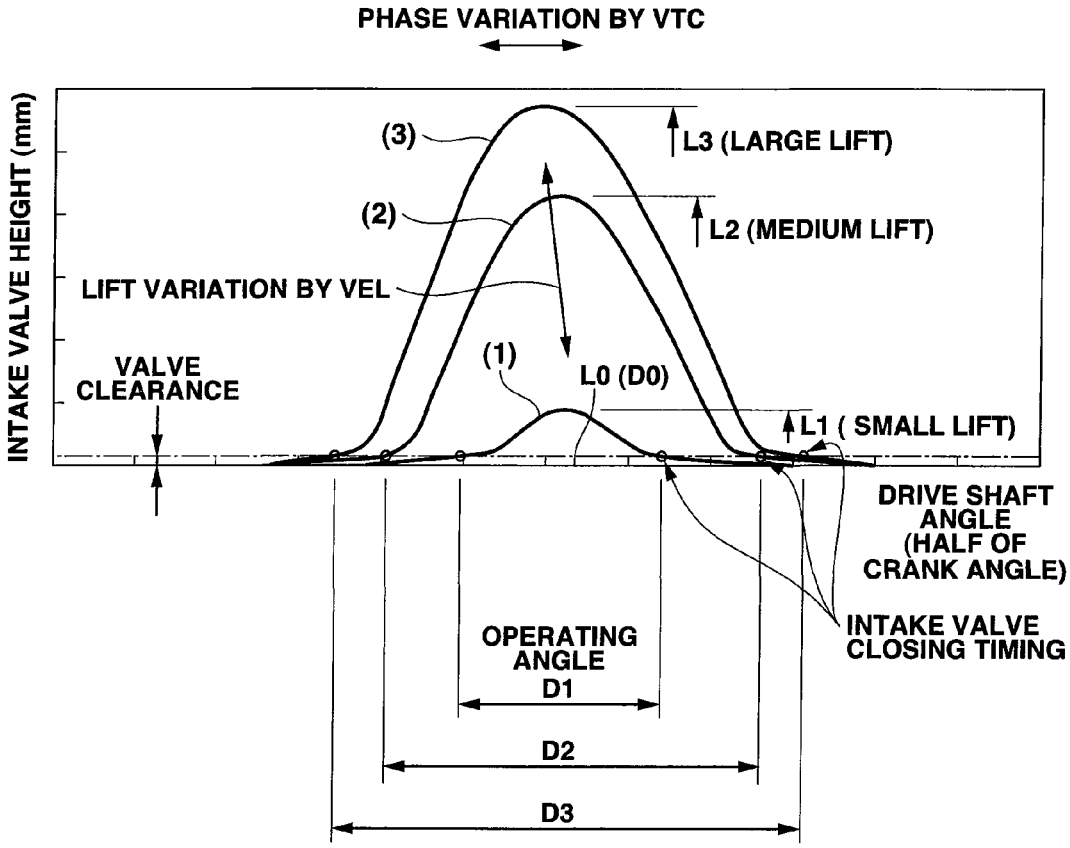
FIG. 5 is a graphic diagram showing how the variable valve actuating system controls the lift, operating angle and phase (or timing) of an intake valve of the engine.

Along with normal or reverse rotation of drive motor 20, ball nut 24 moves in the axial direction of ball screw shaft 23, to move control shaft 17 and others, and thereby vary the lift L and operating angle (valve opening period) D of intake valves 4 continuously between the zero lift setpoint L0 and maximum lift setpoint L3, and between a zero operating angle setpoint D0 and a maximum operating angle setpoint D3, respectively, as shown in FIG. 5.

The thus-constructed valve lift varying mechanism 1 is controlled to operate as follows. When the engine is started by turning on an ignition switch so that electric motor 07 performs cranking operation, drive motor 20 is not yet energized by controller 22. Accordingly, ball nut 24 is still held in the intermediate position by the biasing forces of first and second bias springs 31*a* and 31*b* so that the lift L of intake valves 4 is equal to the medium lift setpoint L2, which serves to achieve preferable engine start.

Figure 3B:
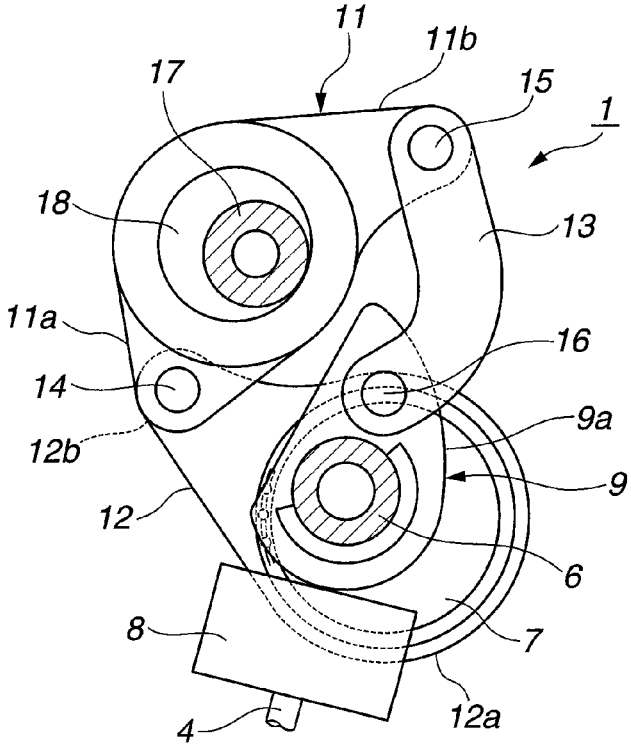

When the engine enters a low load region or shifts into decelerating state, then controller 22 energizes drive motor 20 so that drive motor 20 rotates and thereby ball screw shaft 23 rotates in one rotational direction. Accordingly, ball nut 24 moves rectilinearly toward electric motor 20. With this movement of ball nut 24, the control shaft 17 is rotated in one direction by the link member 26 and connection arm 25. Accordingly, control cam 18 rotates about the axis of control shaft 17 so that the axis of control cam 18 rotates about the axis of control shaft 17, as shown in FIGS. 3A and 3B (in the form of rear view), and a thick wall portion of control cam 18 is shifted upwards from drive shaft 6. As a result, the pivot point between the second end portion 11*b* of rocker arm 11 and link rod 13 is shifted upwards relative to the drive shaft 6. Therefore, each swing cam 9 is rotated in the counterclockwise direction as viewed in FIGS. 3A and 3B, and the cam nose is pulled upwards by link rod 13. Accordingly, drive cam 7 rotates and pushes up the first end portion 11*a* of rocker arm 11 through link arm 12. Though a movement for valve lift is transmitted through link rod 13 to swing cam 9 and valve lifter 8, the valve lift is decreased sufficiently to the zero lift setpoint L0, and the operating angle D is decreased to the zero operating angle setpoint D0, as shown in FIG. 5.

When the engine operating point shifts from the low load region into a medium load region, the controller 22 drives electric motor 20 in a reverse rotational direction, and thereby rotates the ball screw shaft 23 in the reverse direction. With this reverse rotation of ball screw shaft 23, the ball nut 24 moves in the axial direction away from electric motor 20 with the biasing force of second bias spring 31*b* against the biasing force of first bias spring 31*a* and valve reaction force, and control shaft 17 is rotated in the counterclockwise direction as viewed in FIGS. 3A and 3B by a predetermined amount. Therefore, the control cam 18 is held at the angular position at which the axis of control cam 18 is shifted downward by a predetermined amount from the axis of control shaft 17, and the thick wall portion of control cam 18 is shifted downwards. Rocker arm 11 is moved in the clockwise direction from the position of FIGS. 3A and 3B, and the end of rocker arm 11 pushes down the cam nose of swing cam 9 through link member 13, and swing cam 9 rotates in the clockwise direction slightly. Accordingly, drive cam 7 rotates and pushes up the end 11*a* of rocker arm 11 through link arm 12. A movement for valve lift is transmitted through link member 13 to swing cams 9 and valve lifters 8. In this case, the valve lift is increased to a small lift setpoint L1, and then the medium lift setpoint L2, and the operating angle is increased to a small operating angle setpoint D1, and then a medium operating angle setpoint D2. By this control operation, the variable valve actuating system can shift the intake valve closing timing EVC on the retard side toward bottom dead center. By so doing, the variable valve actuating system can enhance the effective compression ratio, and thereby improve the combustion. Moreover, the variable valve actuating system can enhance the fresh air charging efficiency, and thereby increase the combustion torque, and achieve smooth acceleration.

When the lift L is set at or close to the medium lift setpoint L2, the variable valve actuating system advances the intake valve phase by intake valve phase varying mechanism 2. This increases the valve overlap between intake valves 4 and exhaust valves 5, i.e. the period when both of intake valves 4 and exhaust valves 5 are opened. This serves to reduce the pumping loss, and thereby enhance the fuel efficiency.

Figure 4A:
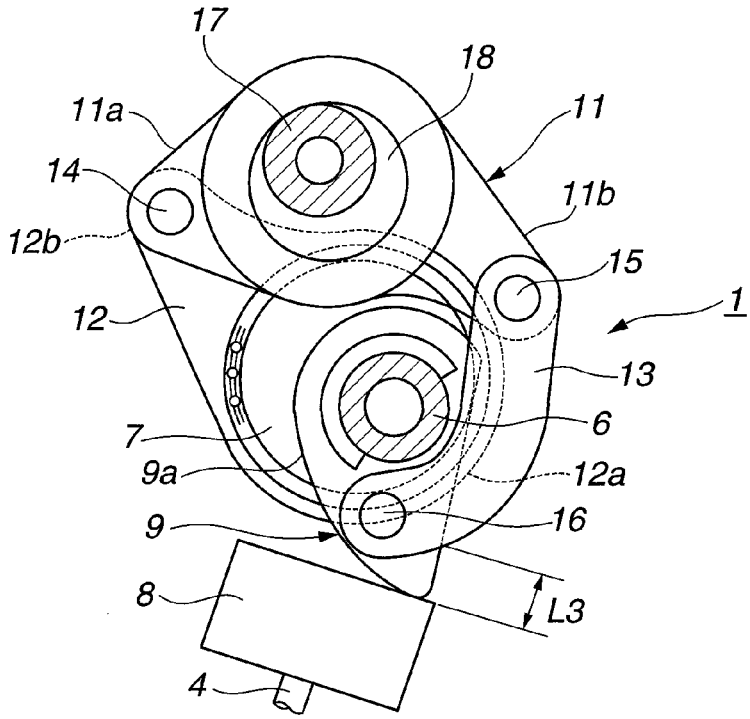
FIGS. 4A and 4B are diagrams illustrating how the valve lift varying mechanism operates when controlled to be in a state of maximum lift.
Figure 4B:
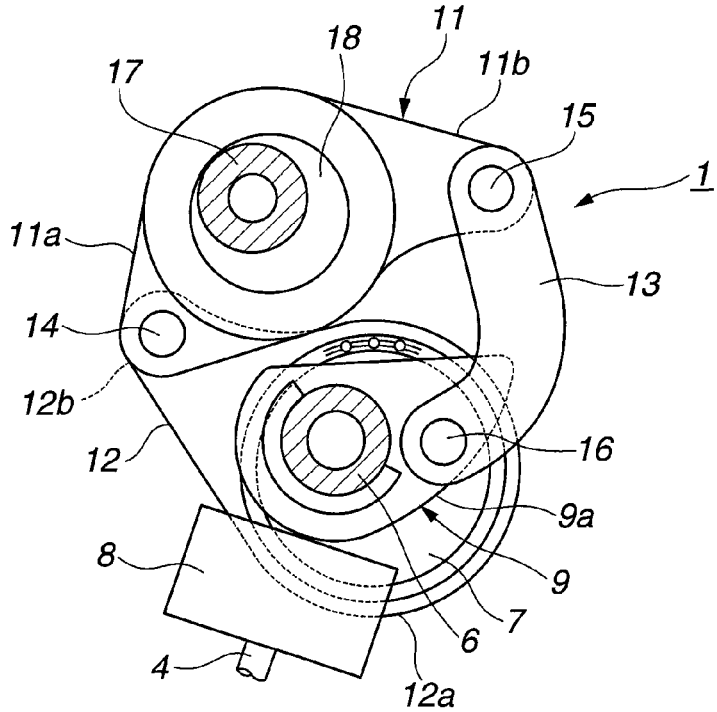

When the engine operating point shifts from the medium load region into a high load region, controller 22 causes by sending the control signal the electric motor 20 to rotate further in the reverse direction, so as to rotate control cam 18 further in the counterclockwise direction with control shaft 17 to the position at which the axis is rotated downwards as shown in FIGS. 4A and 4B. Therefore, rocker arm 11 moves to a position closer to the drive shaft 6, and the second end 11*b* pushes down the cam nose of swing cam 9 through link rod 13, so that the swing cam 9 is further rotated in the clockwise direction by a predetermined amount. Accordingly, drive cam 7 rotates and pushes up the first end 11*a* of rocker arm 11 through link arm 12. A movement for valve lift is transmitted through link rod 13 to swing cam 9 and valve lifter 8. In this case, the valve lift is increased continuously from the medium lift setpoint L2 to the maximum lift setpoint L3, and the valve operating angle is increased continuously from the medium operating angle setpoint D2 to the maximum operating angle setpoint D3, as shown in FIG. 5.

In this way, valve lift varying mechanism 1 can vary the lift L of intake valves 4 according to the operating state of the engine from the zero lift setpoint L0 to the maximum lift setpoint L3, while varying the operating angle D of intake valves 4 continuously from the zero operating angle setpoint D0 to the maximum operating angle setpoint D3

Figure 6:
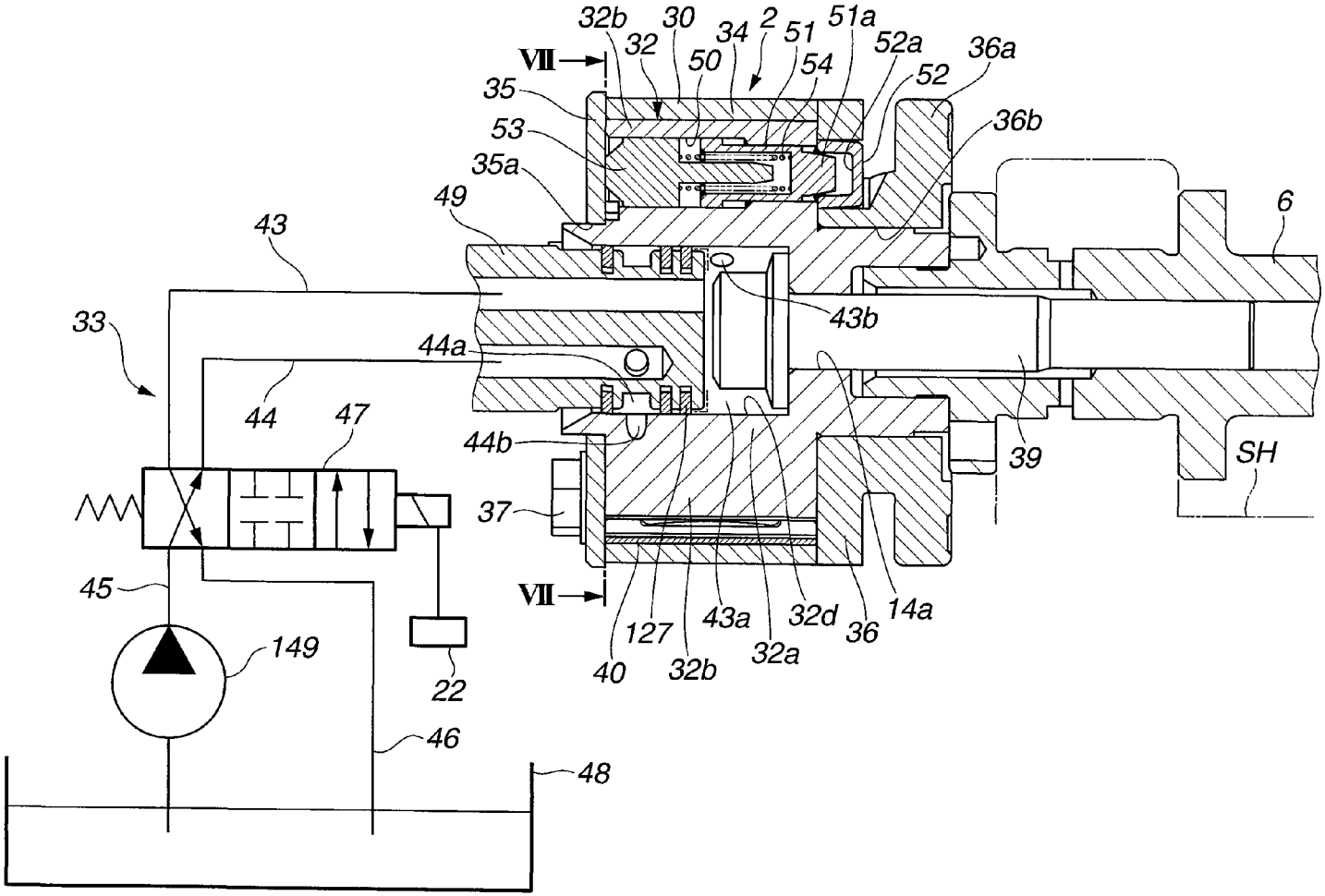
FIG. 6 is a sectional view of the intake valve phase varying mechanism (or exhaust valve phase varying mechanism).
Figure 7:
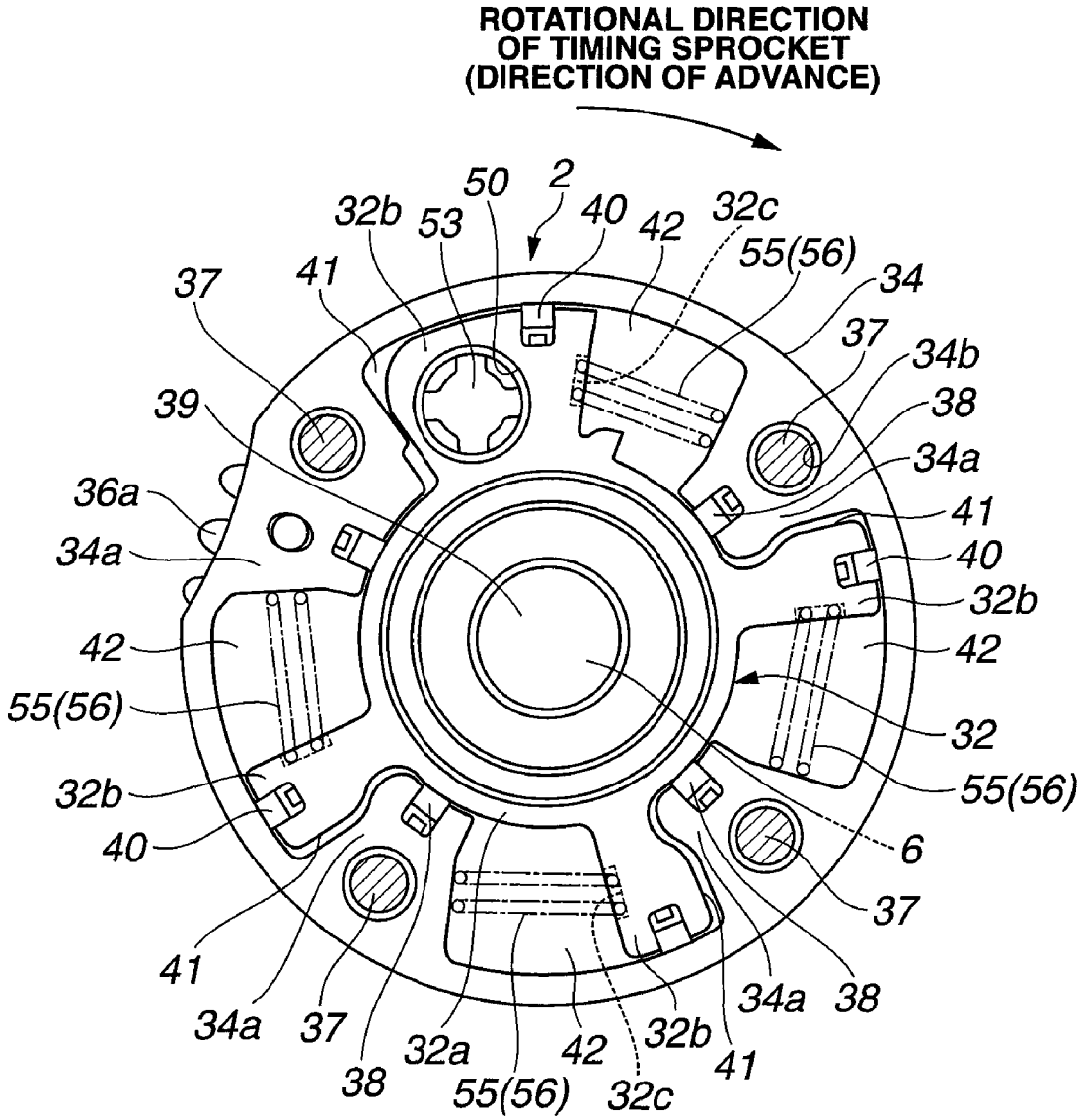
FIG. 7 is a sectional view, taken along a line VII-VII shown in FIG. 6, of the intake valve phase varying mechanism under a condition that the intake valve phase varying mechanism is controlled to be in a most retarded state.
Figure 8:
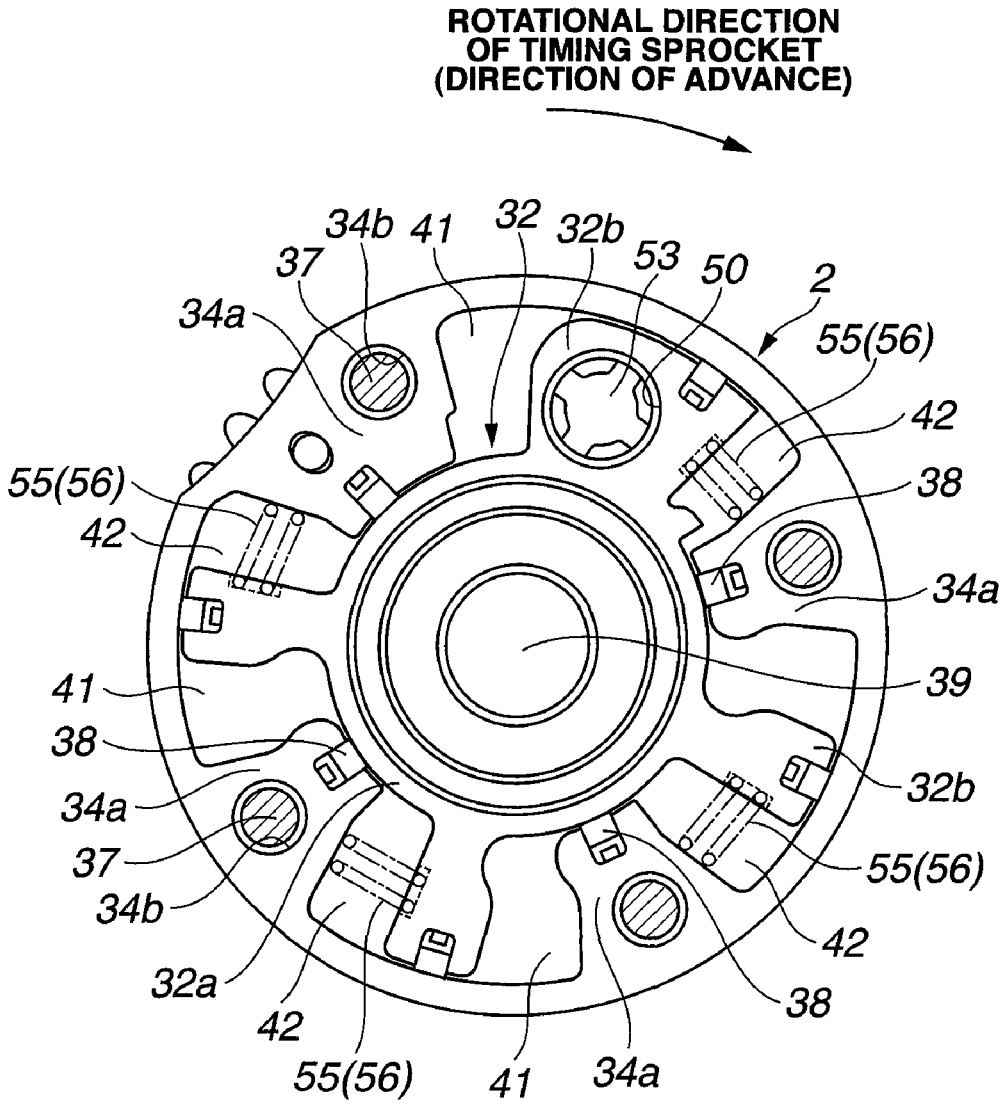
FIG. 8 is a sectional view, taken along the line VII-VII shown in FIG. 6, of the intake valve phase varying mechanism under a condition that the intake valve phase varying mechanism is controlled to be in a most advanced state.

As shown in FIGS. 6, 7 and 8, the intake valve phase varying mechanism 2 of this example is a vane type mechanism including the timing sprocket 30 for transmitting rotation to drive shaft 6; a vane member 32 as a movable member which is fixed to one end of drive shaft 6 and received rotatably in the timing sprocket 30; and a hydraulic circuit 33 to rotate the vane member 32 in the forward and reverse directions by the use of an oil pressure.

Exhaust valve phase varying mechanism 3 is constructed in the same manner as intake valve phase varying mechanism 2. The construction of intake valve phase varying mechanism 2 or exhaust valve phase varying mechanism 3 is detailed below.

Timing sprocket 30 includes a housing 34 receiving the vane member 32 rotatably; a front cover 35 shaped like a circular disk and arranged to close a front opening of housing 34; and a rear cover 36 shaped approximately like a circular disk and arranged to close a rear opening of housing 34. Housing 34 is sandwiched between front and rear covers 35 and 36, and joined with these covers to form a unit, by four small diameter bolts 37 extending in the axial direction of drive shaft 6. Housing 34 thus rotates in synchronization with crankshaft 02.

Housing 34 is in the form of a hollow cylinder having the front and rear openings. Housing 34 includes a plurality of shoes 34*a* projecting radially inwards from the inside circumferential surface and serving as a partition. In this example, four of the shoes 34*a* are arranged at intervals of about 90 degrees.

Each shoe 34*a* has an approximately trapezoidal cross section. A bolt hole 34*b* is formed approximately at the center of each shoe 34*a*. Each bolt hole 34*b* passes axially through one of shoes 34*a*, and receives the shank of one of the axially extending bolts 37. Each shoe 34*a* includes an inner end surface. A retaining groove extends axially in the form of cutout in the inner end surface of each shoe 34*a* at a higher position. A U-shaped seal member 38 is fit in each retaining groove, and urged radially inwards by a leaf spring not shown fit in the retaining groove.

Front cover 35 includes a center support hole 35*a* having a relatively large inside diameter; and four bolt holes not shown each receiving one of the axially extending bolts 37. These four bolt holes are arranged around the center support hole 35*a*, facing respective ones of the bolt holes 34*b* of shoes 34*a*.

Rear cover 36 includes a toothed portion 36*a* formed integrally on the rear side, and arranged to engage with the before-mentioned timing chain; and a center bearing hole 36*b* having a relatively large inside diameter and extending axially through rear cover 36.

Vane member 32 includes a central vane rotor 32*a* and a plurality of vanes 32*b* projecting radially outwards from the vane rotor 32*a*. In this example, four of the vanes 32*b* are arranged at angular intervals of approximately 90 degrees circumferentially around vane rotor 32*a*. Vane rotor 32*a* is annular and includes a center bolt hole 14*a* at the center. Vanes 32*b* are integral with vane rotor 32*a*. Vane member 32 is fixed to the front end of drive shaft 6 by a fixing bolt 39 extending axially through the center bolt hole 14*a* of vane rotor 32*a*.

The vane rotor 32*a* includes a front side small diameter tubular portion supported rotatably by the center support hole 35*a* of front cover 35, and a rear side small diameter tubular portion supported rotatably by the bearing hole 36*b* of rear cover 36.

Three of the four vanes 32*b* are smaller vanes shaped approximately like a relatively long rectangle, and the remaining one is a larger vane shaped like a relatively large trapezoid. The smaller vanes 32*b* are approximately equal in circumferential width whereas the larger vane 32*b* has a larger circumferential width greater than that of each of the smaller vanes 32*b* so that a weight balance is attained as a whole of vane member 32. The four vanes 32*b* of vane member 32 and the four shoes 34*a* of housing 34 are arranged alternately in the circumferential direction around the center axis, as shown in FIGS. 7 and 8. Each vane 32*b* includes an axially extending retaining groove receiving a U-shaped seal member 40 in sliding contact with the inside cylindrical surface of housing 34, and a leaf spring not shown for urging the seal member 40 radially outwards and thereby pressing the seal member 40 to the inside cylindrical surface of housing 34. Moreover, in one side of each vane 32*b* facing in the direction opposite to the rotational direction of drive shaft 6, there are formed two circular recesses 32*c*.

An advance fluid pressure chamber 41 and a retard fluid pressure chamber 42 are formed on both sides of each vane 32*b*. Accordingly, there are four of the advance fluid pressure chambers 41 and four of the retard fluid pressure chambers 42.

As shown in FIG. 6, hydraulic circuit 33 includes a first fluid passage 43 leading to the advance fluid pressure chambers 41 for supplying and draining advance fluid pressure of operating oil to and from advance fluid pressure chambers 41; a second fluid passage 44 leading to the retard fluid pressure chambers 42 for supplying and draining retard fluid pressure of operating oil to and from retard fluid pressure chambers 42; and a directional control valve or selector valve 47 connecting the first fluid passage 43 and second fluid passage 44 selectively with a supply passage 45 and a drain passage 46. A fluid pump 149 is connected with supply passage 45, and arranged to draw the hydraulic operating fluid or brake fluid or oil from an oil pan 48 of the engine, and to force the fluid into supply passage 45. Pump 149 is a one-way type pump. The downstream end of drain passage 46 is connected to oil pan 48, and arranged to drain the fluid to oil pan 48.

First and second fluid passages 43 and 44 include sections formed in a cylindrical portion 49 which is inserted, from a first end, through the small diameter tubular portion of vane rotor 32*a*, into the support hole 32*d* of vane rotor 32*a*. A second end of the cylindrical portion 49 is connected with directional control valve 47.

Between the outside circumferential surface of the cylindrical portion 49 and the inside circumferential surface of support hole 32*d*, there are provided three annular seal members 127 fixedly mounted on the cylindrical portion 49 near the forward end and arranged to seal the first and second fluid passages 43 and 44 off from each other.

First fluid passage 43 includes a passage section 43*a* serving as a pressure chamber, and four branch passages 43*b* connecting the passage section 43*a*, respectively, with the four advance fluid pressure chambers 41. Passage section 43*a* is formed in an end portion of support hole 32*d* on the side of drive shaft 6. The four branch passages 43*b* are formed in vane rotor 32*a* and extend radially in vane rotor 32*a*.

Second fluid passage 44 includes an axially extending passage section extending axially in the cylindrical portion 49 to a closed end; an annular chamber 44*a* formed around the axially extending passage section near the closed end; and an L-shaped passage section 44*b* connecting the annular chamber 44*a* with each retard pressure chamber 42.

Directional control valve 47 of this example is a solenoid valve having four ports and three positions. A valve element inside the directional control valve 47 is arranged to alter the connection between first and second fluid passages 43 and 44 and the supply and drain passages 45 and 46 under the control of the controller 22.

By switching operation of directional control valve 47, working fluid is supplied to retard fluid pressure chambers 42 at engine start, and then supplied to advance fluid pressure chambers 41.

The intake valve phase varying mechanism 2 includes a lock mechanism disposed between vane member 32 and housing 34 for locking the vane member 32 in a predetermined rotational position with respect to housing 34 or allowing the rotation of vane member 32 with respect to housing 34. Specifically, this lock mechanism is disposed between rear cover 36 and the larger vane 32*b*. The lock mechanism includes a slide hole 50, a lock pin 51, a lock recess 52*a*, a spring retainer 53, and a coil spring 54, as shown in FIGS. 6 and 7. Slide hole 50 is formed in the larger vane 32*b*, extending in the axial direction of drive shaft 6. Lock pin 51 is cup-shaped, disposed in slide hole 50, and slidably supported on slide hole 50. Lock recess 52*a* is formed in a portion 52 fixed to a hole defined in rear cover 36, and arranged to receive a tip portion 51*a* of lock pin 51. The tip portion 51*a* is tapered. Spring retainer 53 is fixed to a bottom portion of slide hole 50. Coil spring 54 is retained by spring retainer 53, and arranged to bias the lock pin 51 toward the lock recess 52*a*.

The lock recess 52*a* is hydraulically connected to advance fluid pressure chamber 41 or retard fluid pressure chamber 42 through a fluid passage not shown, and receives the hydraulic pressure in advance fluid pressure chamber 41 or retard fluid pressure chamber 42.

When vane member 32 is in its most retarded position with respect to housing 34, the lock pin 51 is biased by coil spring 54 toward lock recess 52*a* so that the tip portion 51*a* of lock pin 51 is fit in lock recess 52*a*. The relative rotation between timing sprocket 30 and drive shaft 6 is thus locked. When lock recess 52*a* receives the hydraulic pressure in advance fluid pressure chamber 41 or retard fluid pressure chamber 42, then lock pin 51 moves away from lock recess 52*a*, so as to release drive shaft 6 with respect to timing sprocket 30.

Between one side surface of each vane 32*b* and a confronting side surface of an adjacent one of the shoes 34*a*, there are disposed a pair of coil springs 55 and 56 serving as biasing means for urging the vane member 32 in the retard rotational direction. In other words, coil springs 55 and 56 serve as a biasing device arranged to bias the intake valve phase varying mechanism 2 in a direction to retard the valve opening timing and valve closing timing.

Though the two coil springs 55 and 56 are overlapped in FIGS. 7 and 8, the two coil springs 55 and 56 extend separately in parallel to each other. The two coil springs 55 and 56 have an equal axial length (coil length) which is longer than the spacing between the one side surface of the corresponding vane 32*b* and the confronting side surface of the adjacent shoe 34*a*. The two coil springs 55 and 56 are spaced with such an interaxis distance that the springs 55 and 56 do not contact each other even when the springs 55 and 56 are compressed to the maximum extent. The two coil springs 55 and 56 are connected through a retainer shaped like a thin sheet and fit in the recesses 32*c* of the corresponding shoe 34*a*.

The thus-constructed intake valve phase varying mechanism 2 is controlled to operate as follows. Exhaust valve phase varying mechanism 3 is controlled to operate in a similar manner.

When the engine is stopped or at rest, the controller 22 stops the output of the control current to directional control valve 47, so that the valve element of directional control valve 47 is placed in the default position as shown in FIG. 6 so as to allow fluid communication between supply passage 45 and second fluid passage 44 leading to retard fluid pressure chamber 42, and allow fluid communication between drain passage 46 and first fluid passage 43. Also, when the engine is at rest, the supplied fluid pressure is equal to zero, because oil pump 149 is also inoperative. Accordingly, vane member 32 is biased by coil springs 55, 56, so as to rotate in the counterclockwise direction about the axial direction of drive shaft 6 as viewed in FIG. 7. As a result, vane member 32 is brought into a position such that the larger vane 32*b* is in contact with one confronting side surface of shoe 34*a*. Drive shaft 6 is thus in the most retarded position with respect to timing sprocket 30. The intake valve phase varying mechanism 2 is thus mechanically and stably held in its default position for most retarded intake valve opening timing IVO and intake valve closing timing IVC.

In this way, when the engine is at rest, intake valves 4 are stably held at the medium lift setpoint L2 by valve lift varying mechanism 1, and stably held at the most retarded timing by intake valve phase varying mechanism 2, so that the intake valve closing timing IVC is at or close to bottom dead center. On the other hand, exhaust valves 5 are stably held at the most retarded phase setpoint by exhaust valve phase varying mechanism 3, wherein the valve phase is normally controlled to be at or close to the most retarded phase setpoint. This construction makes it possible to drive the internal combustion engine even without power supply from an electrical system or hydraulic system, which achieves a fail safe system.

When the engine is started by turning on the ignition switch and cranking the crankshaft 02 with electric motor 07, the intake valve closing timing IVC is still held at or close to bottom dead center during an initial stage of cranking operation. Then, after the vehicle starts to run to warm up the engine, and the engine operating point enters a predetermined low and medium load region, the directional control valve 47 starts to operate in response to a control signal from controller 22, and then allows fluid communication between supply passage 45 and first fluid passage 43, and between drain passage 46 and second fluid passage 44. Therefore, the oil pressure in retard fluid pressure chambers 42 is decreased by return through second fluid passage 44 and drain passage 46 to oil pan 48, whereas the oil pressure in advance fluid pressure chambers 41 is increased by supply of the oil pressure. Vane member 32 rotates in the clockwise direction by the high pressure in advance fluid pressure chambers 41, against the elastic forces of coil springs 55 and 56, and thereby shifts the relative rotational phase of drive shaft 6 relative to timing sprocket 30 to the advance side, as shown in FIG. 8. On the other hand, valve lift varying mechanism 1 is controlled to a relatively large operating angle setpoint. Therefore, the valve overlap between intake valves 4 and exhaust valves 5 is increased. This setting serves to reduce the pumping loss, and thereby enhance the fuel efficiency.

When the engine shifts from the low and medium load region into a normally used medium load region, and further into a high load region, then directional control valve 47 is controlled so that the oil pressure in advance fluid pressure chambers 41 decreases, the oil pressure in retard fluid pressure chambers 42 increases, and hence the resultant of the hydraulic pressures and the elastic forces of coil springs 55 and 56 causes the vane member 32 to shift the relative rotational phase of drive shaft 6 relative to timing sprocket 30 to the retard side, as shown in FIG. 7. On the other hand, valve lift varying mechanism 1 sets the valve lift L and operating angle D to the maximum operating angle setpoint D3 and maximum lift setpoint L3. These operations set the intake valve closing timing IVC sufficiently retarded while maintaining a some amount of valve overlap between intake valves 4 and exhaust valves 5, and thereby enhance the fresh air charging efficiency. This serves to enhance the output of the engine.

Figure 9:
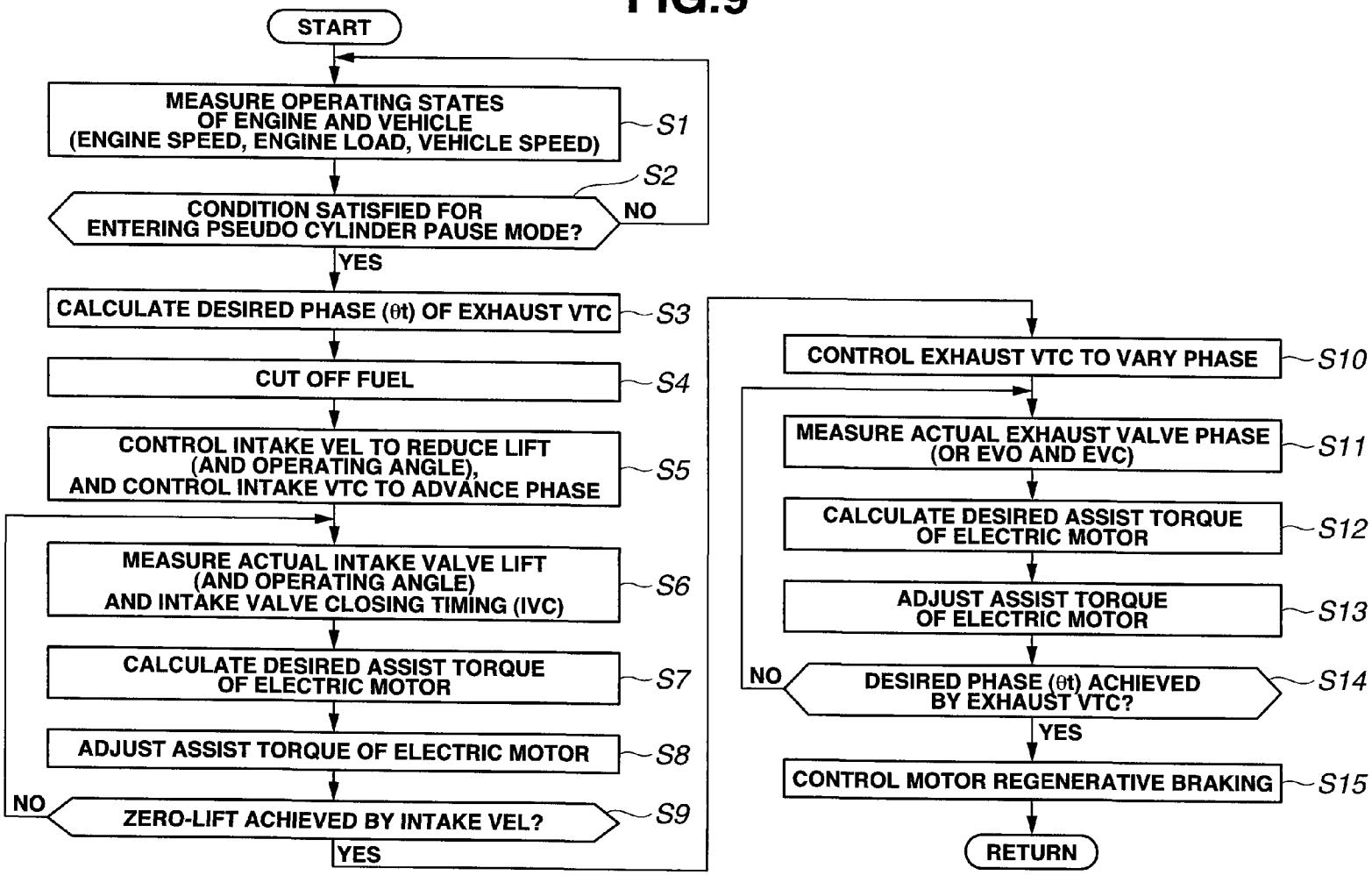
FIG. 9 is a flow chart showing a control process which is performed by a controller of the variable valve actuating system.

FIG. 9 shows a control process performed by controller 22. After engine start by turning on the ignition switch, controller 22 measures or reads at Step S1 information about the current operating states of the engine and vehicle which is outputted from the sensors. The information includes information about engine speed, engine load, and vehicle speed.

At Step S2, controller 22 determines whether or not a predetermined condition is satisfied for entering a predetermined pseudo cylinder pause mode. Specifically, controller 22 determines that this condition is satisfied, when determining that the vehicle is in decelerating state or that the engine is in low load state. When the answer to step S2 is negative (NO), then controller 22 returns to Step S1. On the other hand, when the answer to step S2 is affirmative (YES), then controller 22 proceeds to Step S3.

At Step S3, controller 22 calculates a desired advance angle θt of exhaust valves 5. In normal cases, the desired advance angle θt is set so that the lift central phase (central point between exhaust valve opening timing and exhaust valve closing timing) of exhaust valves 5 is at or close to bottom dead center.

At Step S4, controller 22 performs a fuel cut control of cutting off fuel supply to combustion chamber 04.

After Step S4, controller 22 outputs at Step S5 a control signal for valve lift varying mechanism 1 to reduce the lift and operating angle of intake valves 4, or specifically set the lift and operating angle of intake valves 4 to the zero lift setpoint L0 and zero operating angle setpoint D0, and outputs a control signal for intake valve phase varying mechanism 2 to advance the phase of intake valves 4.

At Step S6, controller 22 measures the actual lift (and/or operating angle) of intake valves 4 by the position sensor provided for valve lift varying mechanism 1, and measures the intake valve closing timing IVC by the position sensor provided for intake valve phase varying mechanism 2.

At Step S7, controller 22 calculates a desired assist torque of electric motor 07 for canceling a pumping loss that is transiently generated due to the setting of the intake valve closing timing IVC at Step S6.

At Step S8, controller 22 controls or adjusts the assist torque of electric motor 07 according to the calculated desired assist torque. The processings of Steps S6, S7 and S8 are repeated until the intake valve lift reaches the zero lift setpoint L0 under.

At Step S9, controller 22 determines whether or not the intake valve lift has reached the zero lift setpoint L0. When the answer to Step S9 is NO, controller 22 returns to Step S6. On the other hand, when the answer to Step S9 is YES, controller 22 proceeds to Step S10.

At Step S10, controller 22 outputs a control signal for exhaust valve phase varying mechanism 3 to set the phase of exhaust valves 5, 5 to the desired advance angle θt.

At Step S11, controller 22 measures the actual phase of exhaust valves 5 set by exhaust valve phase varying mechanism 3 (or exhaust valve opening timing EVO and exhaust valve closing timing EVC).

At Step S12, controller 22 calculates a desired assist torque of electric motor 07 which serves to cancel a pumping loss that is transiently generated due to the setting of the exhaust valve opening timing EVO and exhaust valve closing timing EVC at Step S11.

At Step S13, controller 22 controls or adjusts the assist torque of electric motor 07 according to the calculated desired assist torque. The processings of Steps S11 to S13 are repeated until the phase of exhaust valves 5 reaches the desired advance angle θt.

At Step S14, controller 22 determines whether or not the phase of exhaust valves 5 has reached the desired advance angle θt. When the answer to Step S14 is NO, controller 22 returns to Step S11. On the other hand, when the answer to Step S14 is YES, controller 22 proceeds to Step S15 on the assumption that the engine has entered the pseudo cylinder pause mode in which the engine braking or pumping loss is sufficiently small.

At Step S15, controller 22 outputs a control signal to an inverter for electric motor 07 to produce regenerative braking. This regenerative braking serves to achieve desired deceleration of the vehicle, and charge the battery with regenerated power. The charged energy can be used for electric motor 07 to drive the vehicle electronically, which serves to enhance the overall fuel efficiency of the vehicle.

In this way, controller 22 is configured to perform a control operation in response to a request to pause at least one cylinder of the internal combustion engine while the internal combustion engine is in operation, wherein the control operation includes: a first operation of setting the intake valve lift to the zero-lift setpoint by valve lift varying mechanism 1; and a second operation of setting the exhaust valve phase by exhaust valve phase varying mechanism 3 after the first operation so as to set the exhaust valve opening timing EVO to a first timing setpoint on an advance side of bottom dead center and set the exhaust valve closing timing EVC to a second timing setpoint on a retard side of bottom dead center, wherein the first and second timing setpoints are closer to top dead center than to bottom dead center. In the first embodiment, the first timing setpoint is substantially as close to bottom dead center as the second timing setpoint. Controller 22 is configured to perform the control operation for at least part of cylinders of the internal combustion engine in response to determination that a vehicle provided with the internal combustion engine is decelerating under a predetermined condition. Controller 22 is configured to perform the control operation for all or part of cylinders of the internal combustion engine in response to determination that the internal combustion engine is operating in a predetermined low load region. The control operation includes a third operation of controlling the electric motor 07 so as to cancel transient change in the driving torque during the control operation. Exhaust valve phase varying mechanism 3 is arranged to stabilize the exhaust valve phase at a setpoint on a retard side of the maximally advanced setpoint when exhaust valve phase varying mechanism 3 is in non-driven state, and is configured so that the exhaust valve opening timing is at the first timing setpoint and the exhaust valve closing timing is at the second timing setpoint when the exhaust valve phase is at a maximally advanced setpoint allowed by exhaust valve phase varying mechanism 3.

Figure 10:
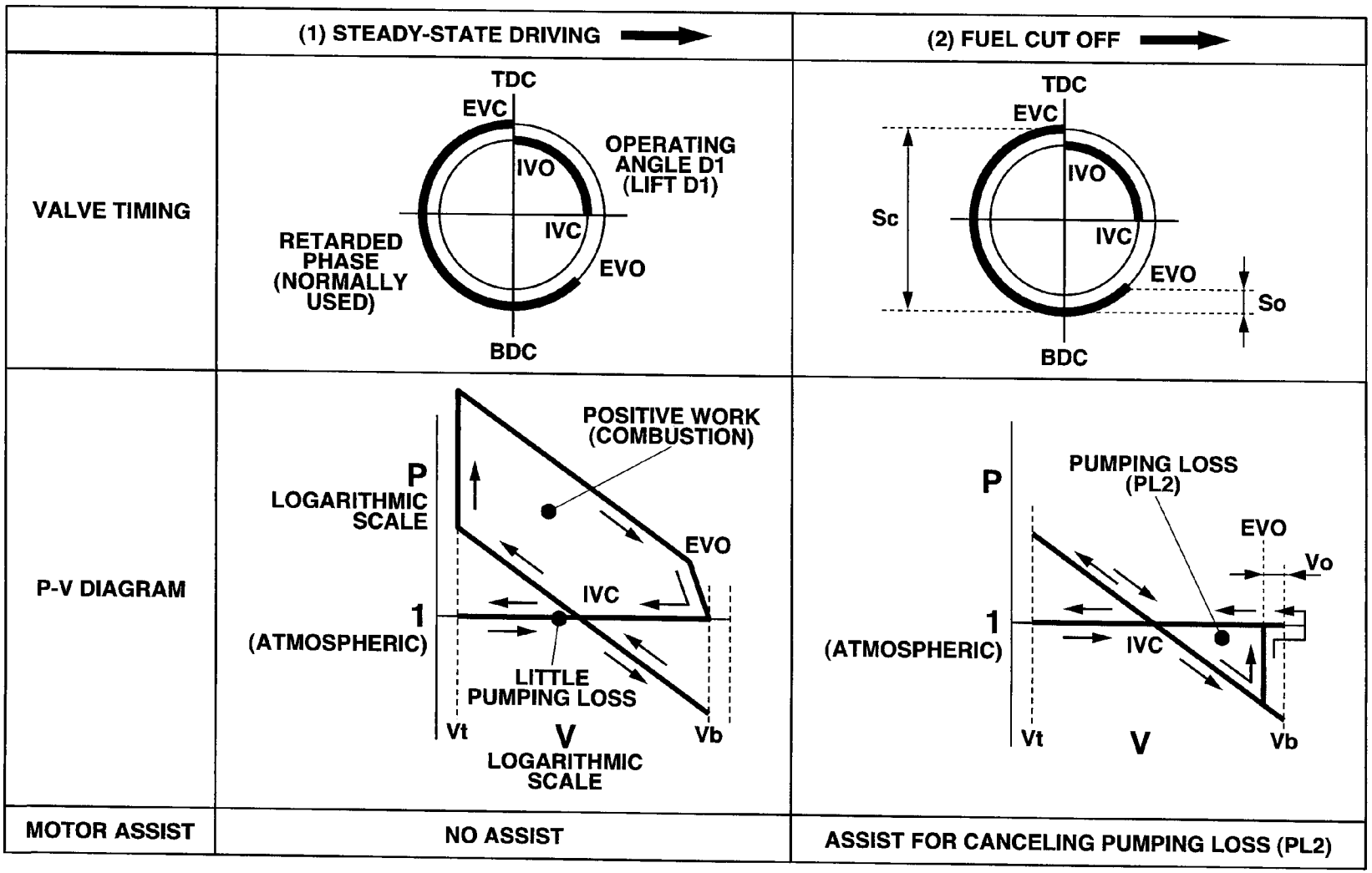
FIG. 10 is a diagram showing characteristics of operation of intake valves and exhaust valves, the pressure-volume diagram (P-V diagram), and the state of motor assist under (1) a condition of steady-state driving, and showing the same under (2) a condition of fuel cut off.
Figure 11:
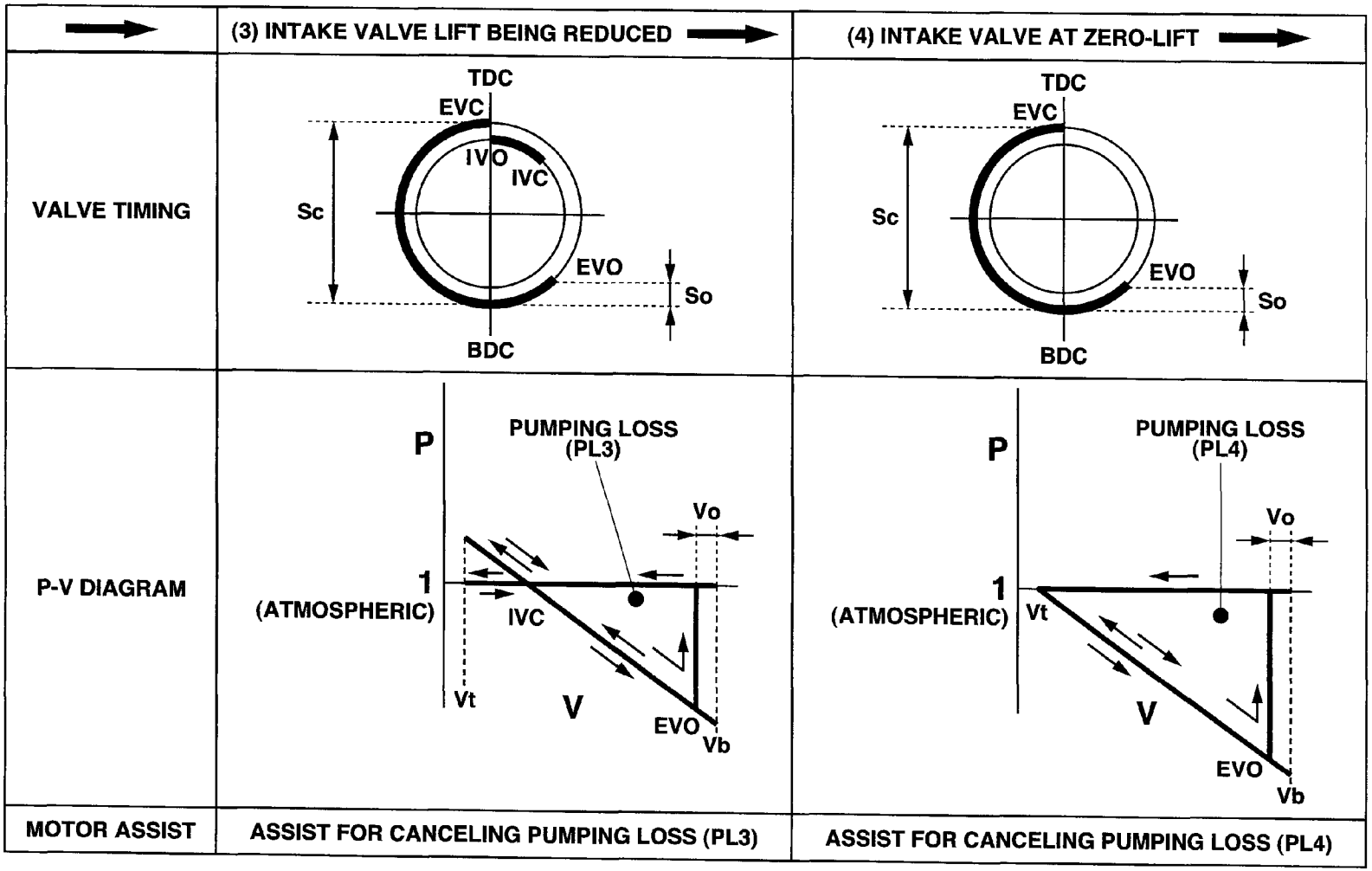
FIG. 11 is a diagram showing the characteristics of operation of intake valves and exhaust valves, the P-V diagram, and the state of motor assist under (3) a condition of intake valve lift being reduced, and showing the same under (4) a condition of intake valve lift at a zero lift setpoint.
Figure 12:
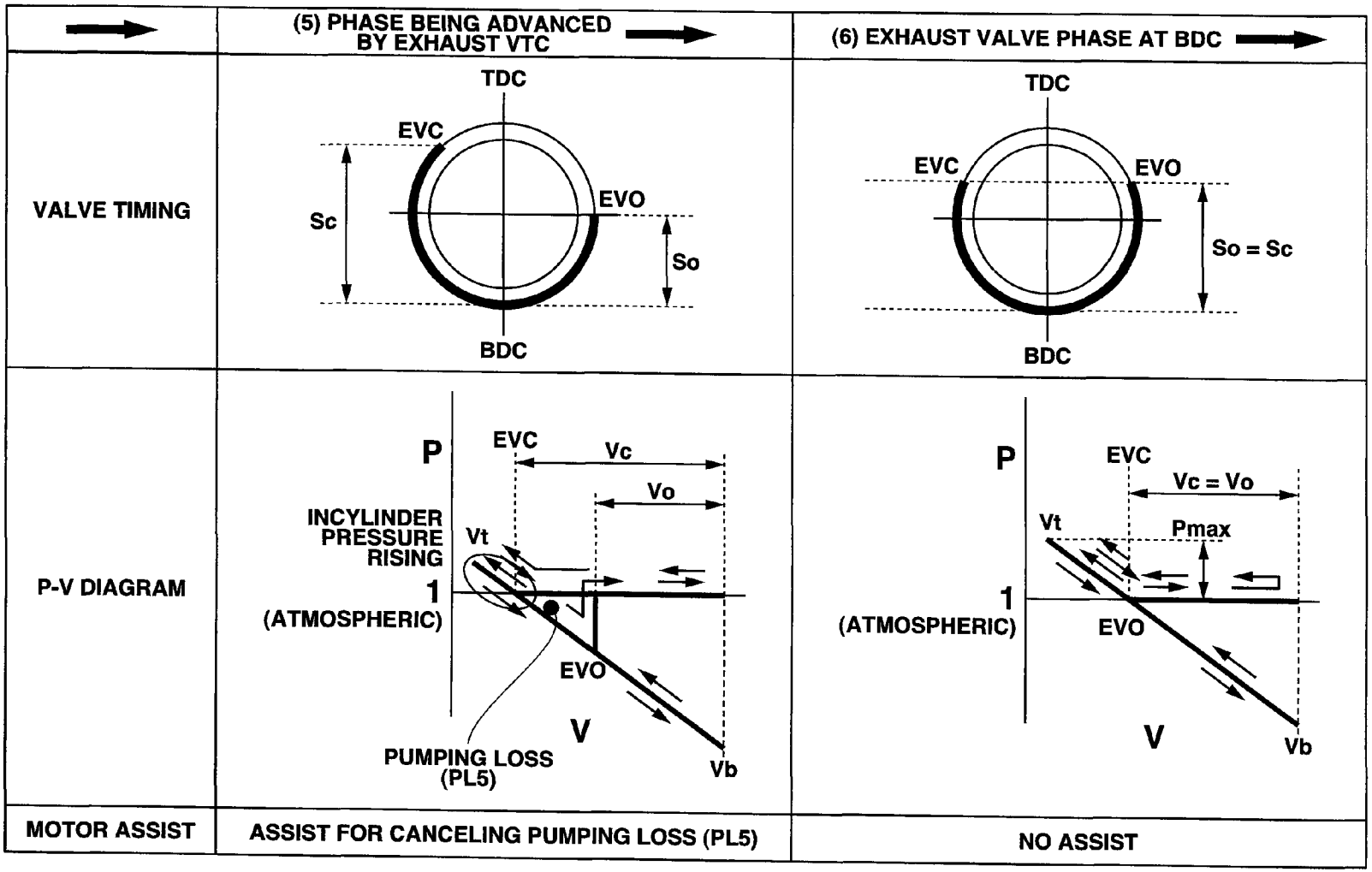
FIG. 12 is a diagram showing the characteristics of operation of intake valves and exhaust valves, the P-V diagram, and the state of motor assist under (5) a condition of exhaust valve phase being advanced, and showing the same under (6) a condition of exhaust valve phase at bottom dead center.

The foregoing control process produces the following advantageous effects. FIGS. 10 to 12 show a transitional process until the shift to the pseudo cylinder pause mode is completed after the determination to shift to the pseudo cylinder pause mode is made.

FIG. 10 shows an operating state (1) in which the vehicle is traveling in steady state before the shift to the pseudo cylinder pause mode is determined, for example, an operating state in which the vehicle is traveling on an express highway while driven only by the internal combustion engine. In this operating state, exhaust valve phase varying mechanism 3 sets the phase of exhaust valves 5 to the retard side which is normally used.

On the other hand, the operating angle D of intake valves 4 is set to the small operating angle setpoint D1 by valve lift varying mechanism 1 and the phase of intake valves 4 is set to an advanced timing by intake valve phase varying mechanism 2 so that the intake valve closing timing IVC is much advanced from bottom dead center, which forms a combustion cycle called early closing Miller cycle.

In the operating state (1), little pumping loss is generated as shown in the P-V diagram so that the engine operates with preferable fuel efficiency, because the amount of intake air can be controlled only by valve timing adjustment with throttle valve SV fully opened.

When the engine shifts from the operating state (1) into an operating state (2) in which fuel is cut off, a pumping loss is transiently generated. In this operating state, no positive work is produced by the engine, and thereby the in cylinder pressure immediately before the exhaust valve opening timing EVO is lower than atmospheric (or lower than 1), which is called negative pressure with respect to atmospheric pressure. At the exhaust valve opening timing EVO, exhaust gas of substantially atmospheric pressure in exhaust port EP returns through exhaust valves 5, and flows into the cylinder. Then, after bottom dead center, the exhaust gas returned from exhaust port EP flows out of the cylinder again. This results in a transient pumping loss (pumping loss PL2) that is represented by an area surrounded by a triangle in the P-V diagram.

The pumping loss PL2 results in a negative driving torque or torque shock applied to the vehicle, which is canceled by producing an assist torque with electric motor 07.

FIG. 11 shows an operating state (3) in which the operating angle D of intake valves 4 is reduced further by valve lift varying mechanism 1, and the phase of intake valves 4 is slightly advanced, so that the intake valve closing timing IVC is advanced further while the intake valve opening timing IVO is substantially held constant. Accordingly, in the P-V diagram, the point of the intake valve closing timing IVC (point where the gradient changes) becomes closer to the point of top dead center (point of volume Vt), so that the area surrounded by the triangle (i.e. pumping loss PL3) is increased. In response, the motor assist by electric motor 07 is increased so as to cancel the pumping loss PL3.

When the engine shifts from the operating state (3) into an operating state (4) in which the lift L of intake valves 4 becomes zero and the operating angle D becomes zero, the triangle indicating the pumping loss PL4 is increased further in the P-V diagram. In response, the motor assist by electric motor 07 is increased so as to cancel the pumping loss PL4.

After the operating state (4) is achieved, the variable valve actuating system starts to advance the phase of exhaust valves 5 by exhaust valve phase varying mechanism 3 (Steps S10 to S14).

FIG. 12 shows an operating state (5) in which the phase of exhaust valves 5 is varied so that the exhaust valve opening timing EVO is set at or close to the midpoint between compression top dead center and expansion bottom dead center. Accordingly, in the timing chart, the stroke So from the point of exhaust valve opening timing EVO to bottom dead center is increased. On the other hand, the exhaust valve closing timing EVC is also advanced from exhaust top dead center, and thereby the stroke Sc from bottom dead center to the point of exhaust valve closing timing EVC is reduced.

As a result, in the P-V diagram, the volume Vo corresponding to the exhaust valve opening timing EVO is increased, and the volume Vc corresponding to the exhaust valve closing timing EVC is reduced. Therefore, the pumping loss PL5 represented by the area of the triangle becomes smaller.

In the operating state (5), the exhaust valve closing timing EVC is before exhaust top dead center during the second half of exhaust stroke. Accordingly, as the piston moves upward after the exhaust valve closing timing EVC, the incylinder pressure rises.

FIG. 12 shows an operating state (6) in which the phase of exhaust valves 5 is advanced further by exhaust valve phase varying mechanism 3 so that So=Sc is satisfied, i.e. so that the exhaust valve opening timing EVO is symmetrical with the exhaust valve closing timing EVC with respect to bottom dead center, i.e. that the lift central phase or timing of exhaust valves 5 is at bottom dead center. Moreover, the exhaust valve opening timing EVO and exhaust valve closing timing EVC are closer to top dead center than to bottom dead center.

Since the condition of Vo=Vc is satisfied, the triangle of pumping loss is almost eliminated, so that the pumping loss is significantly reduced.

At the exhaust valve opening timing EVO, the incylinder pressure is almost equal to atmospheric pressure. Accordingly, exhaust gas flows into the cylinder during a period from the exhaust valve opening timing EVO to bottom dead center in which there is little differential pressure, and flows out of the cylinder during a period from bottom dead center to the exhaust valve closing timing EVC in which there is little differential pressure. This serves to sufficiently reduce the pumping loss.

In this way, the variable valve actuating system obtains desired large regenerated energy, and thereby achieves an enhanced vehicle fuel efficiency. Moreover, in contrast to a construction in which the exhaust side is provided with a valve pausing mechanism as well as the intake side, the pseudo cylinder pause mode according to the present embodiment is implemented by the simple construction that allows exhaust gas to flow into and out of the cylinder through the exhaust valves. Still moreover, the feature that exhaust gas does not remain in a closed space of the cylinder, serves to eliminate contamination in the cylinder.

In the engine, exhaust gas flows repeatedly through a catalytic converter disposed down stream of the cylinder. This serves to warm up the catalytic converter well and maintain the catalytic converter warmed up, and allows the catalytic converter to treat exhaust emissions well.

The incylinder peak pressure Pmax in the operating state (6) is suppressed to be relatively small as shown in FIG. 12. This is because the exhaust valve opening timing EVO and exhaust valve closing timing EVC are closer to top dead center than to bottom dead center, so that the stroke So (=Sc) of the piston is long, the corresponding volume Vo (=Vc) is relatively large, and the effective compression stroke from Vc (the point of EVC) to Vt (the point of top dead center). This low incylinder peak pressure Pmax is effective for suppressing vibration and noise of the engine.

Figure 13A:
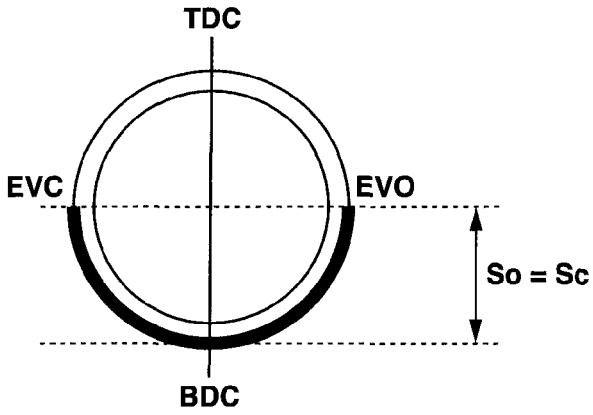
FIGS. 13A and 13B are diagrams showing the characteristics of operation of intake valves and exhaust valves, and the P-V diagram, for a reference example in which the exhaust valve opening timing and exhaust valve closing timing are closer to bottom dead center than in the first and second embodiments.
Figure 13B:
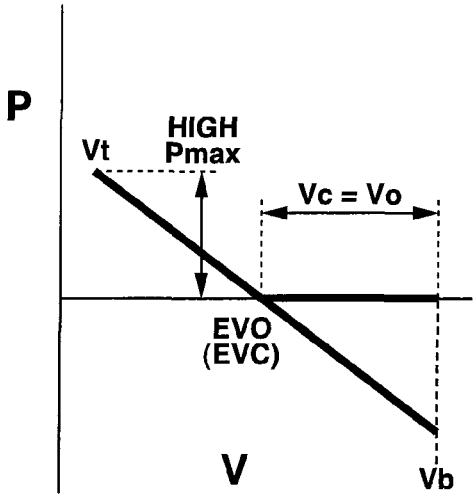

FIGS. 13A and 13B show the characteristics of operation of intake valves and exhaust valves, and the P-V diagram, for a reference example in which the exhaust valve opening timing EVO and exhaust valve closing timing EVC are closer to bottom dead center than in the first and second embodiments, specifically, in which the exhaust valve opening timing EVO and exhaust valve closing timing EVC are just at midpoints between bottom dead center and top dead center. This setting leads to a relatively high incylinder peak pressure Pmax because the effective compression stroke from Vc (the point of EVC) to Vt (the point of top dead center) is long, and thereby results in greater vibration and noise of the engine.

During the transitional process shown in FIGS. 10 to 12, the pumping loss or engine braking increases from about zero, through the pumping loss PL2 and the pumping loss PL3, to the pumping loss PL4, as the operating angle D decreases to the zero operating angle setpoint D0. As the phase of exhaust valves 5 is advanced by exhaust valve phase varying mechanism 3 thereafter, the pumping loss decreases from the pumping loss PL4, through the pumping loss PL5, to the pumping loss that is nearly equal to zero. Although a negative driving torque component is produced transiently in this process, electric motor 07 is controlled to produce a positive driving torque component for canceling the negative driving torque component. This prevents a driver from being subject to torque shocks.

The feature that it is after the lift L of intake valves 4 is set to the zero lift setpoint L0 that the phase of exhaust valves 5 is set to bottom dead center, serves to prevent incylinder gas from flowing out to the suction side.

Figure 14A:
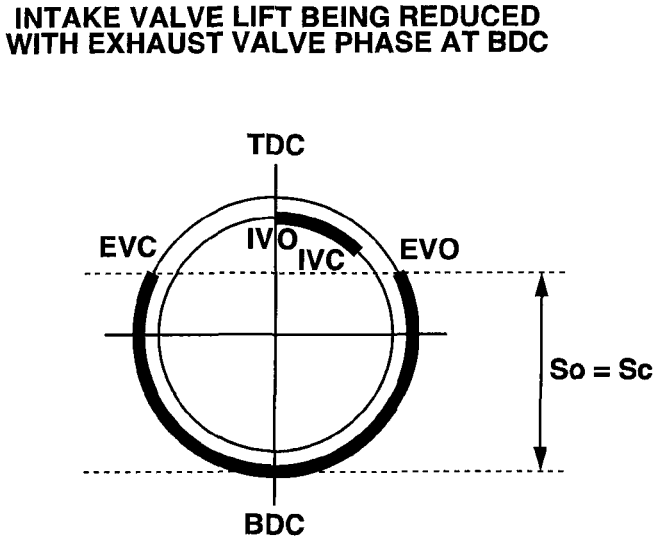
FIGS. 14A and 14B are diagrams showing the characteristics of operation of intake valves and exhaust valves, and the P-V diagram, for a reference example in which exhaust valve lift central timing is set at bottom dead center, and then the intake valve lift is set to a zero-lift setpoint.
Figure 14B:
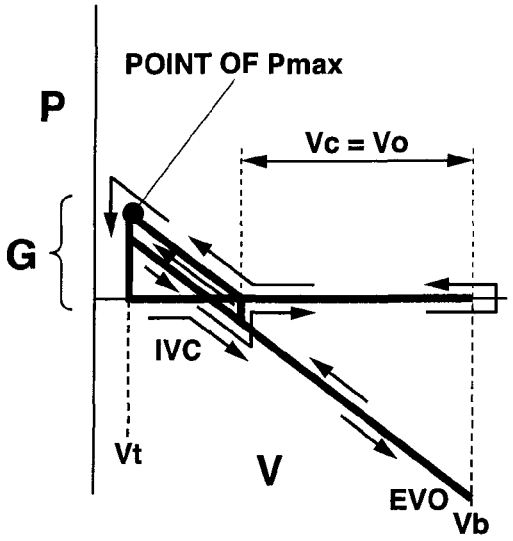

FIGS. 14A and 14B show the characteristics of operation of intake valves and exhaust valves, and the P-V diagram, for a reference example in which exhaust valve lift central timing is set at bottom dead center, and then the intake valve lift is set to a zero-lift setpoint. The fact that the piston moves upward to the top dead center position in the exhaust stroke after the exhaust valve closing timing EVC, and then intake valves 4 open immediately after the incylinder peak pressure Pmax is reached, results in that high pressure gas flows back to the intake side in a region indicated by G in FIG. 14B. This causes noise in the intake side, and thereby adversely affects the quietness of the engine system.

In contrast to the example shown in FIGS. 14A and 14B, the variable valve actuating system according to the present embodiment functions to prevent high pressure gas from flowing back to the intake side, which serves to enhance the quietness.

The advantageous effect of delayed control of the phase of exhaust valves 5 may be implemented by an operation that control signals are outputted simultaneously, and the phase of exhaust valves 5 is changed more slowly than the lift L of intake valves 4 is changed, in contrast to the operation described above that the control signal for intake valves 4 is outputted in advance, and thereafter the control signal for exhaust valves 5 is outputted.

In summary, the variable valve actuating system according to the present embodiment is advantageous in achieving a pseudo cylinder pause mode without a complex valve lift varying mechanism provided for the exhaust side, and thereby reducing the manufacturing cost. Moreover, this variable valve actuating system is advantageous in reducing the incylinder pressure when in the pseudo cylinder pause mode, and thereby enhancing the quietness of the engine system.

Second Embodiment

Figure 15A:
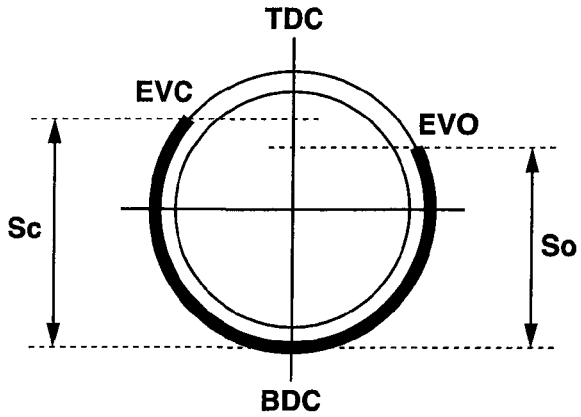
FIGS. 15A and 15B are diagrams showing the characteristics of operation of intake valves and exhaust valves, and the P-V diagram, for the second embodiment in which the intake valve closing timing is farther from bottom dead center than the intake valve opening timing.
Figure 15B:
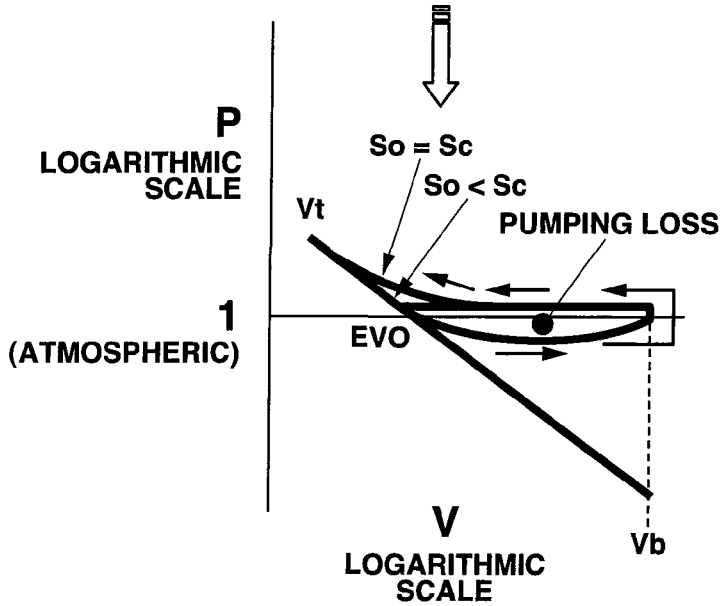

FIGS. 15A and 15B show the characteristics of operation of intake valves and exhaust valves, and the P-V diagram, for the second embodiment in which the intake valve closing timing EVC is farther from bottom dead center than the intake valve opening timing EVO, i.e. the stroke Sc corresponding to the exhaust valve closing timing EVC is longer than the stroke So corresponding to the exhaust valve opening timing EVO.

Specifically, controller 22 is configured to perform a control operation in response to a request to pause at least one cylinder of the internal combustion engine while the internal combustion engine is in operation, wherein the control operation includes: a first operation of setting the intake valve lift to the zero-lift setpoint by valve lift varying mechanism 1; and a second operation of setting the exhaust valve phase by exhaust valve phase varying mechanism 3 after the first operation so as to set the exhaust valve opening timing EVO to a first timing setpoint on an advance side of bottom dead center and set the exhaust valve closing timing EVC to a second timing setpoint on a retard side of bottom dead center, wherein the first and second timing setpoints are closer to top dead center than to bottom dead center, and the first timing setpoint is closer to bottom dead center than the second timing setpoint. Controller 22 is further configured to: set the first timing setpoint substantially as close to bottom dead center as the second timing setpoint in response to determination that the internal combustion engine is rotating below a predetermined speed setpoint; and set the first timing setpoint closer to bottom dead center than the second timing setpoint in response to determination that the internal combustion engine is rotating above the predetermined speed setpoint.

In general, as engine speed rises, the inertia of intake air and the inertia of exhaust gas increase. Regarding the incylinder pressure during a period from the exhaust valve opening timing EVO to bottom dead center, the incylinder pressure is almost equal to atmospheric pressure when engine speed is low. In contrast, the incylinder pressure during this period is lower when engine speed is high due to the inertia of incylinder gas. At or close to bottom dead center, the piston speed decelerates significantly so that the incylinder pressure rises back. When the piston moves upward rapidly from bottom dead center, incylinder gas does not smoothly flow out of the cylinder due to its inertia. Exhaust valve 5 is in mushroom form, so that the flow path from the valve head to the valve steam has a relatively high flow resistance. This makes it further difficult to exhaust incylinder gas quickly from the cylinder when engine speed is high. As a result, the incylinder pressure is higher than atmospheric after bottom dead center. At the exhaust valve closing timing EVC, exhaust valves 5 are rapidly moved to close the port, so that the incylinder pressure rises further. This process increases the pumping loss represented by the area of the triangle in the P-V diagram.

In contrast, the feature according to the second embodiment that the intake valve closing timing is farther from bottom dead center than the intake valve opening timing, serves to reduce the incylinder pressure as indicated by a lower-side curved line in FIG. 15B, and thereby reduce the pumping loss. This feature serves to suppress an increase in pumping loss that results from a rise in engine speed, and thereby suppress a decrease in vehicle fuel efficiency that results from a rise in engine speed.

The first and second embodiments may be modified differently. For example, valve lift varying mechanism 1 may be modified differently. Although valve lift varying mechanism 1 according to the first and second embodiments carries out continuous variation of the operating angle D and lift L of intake valves 4 by means of swing cam 9, the continuous variation may be implemented with a three-dimensional cam that is arranged to be moved in the axial direction. Moreover, the continuous variation may be replaced with stepwise variation implemented by stepwise movement of operating cams.

As described above, the variable valve actuating system according to the present embodiments employs electric motor 07 as a driving power source other than the engine. Electric motor 07 may be a large electric motor that is provided to an electric hybrid vehicle and capable of driving the vehicle without engine power, or a small electric motor that is provided only for power regeneration.

The entire contents of Japanese Patent Application 2009-277153 filed Dec. 7, 2009 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A control apparatus for an internal combustion engine, wherein:

the internal combustion engine is provided with:

a valve lift varying mechanism arranged to vary an intake valve lift of the internal combustion engine, and set the intake valve lift at least to a non-zero lift setpoint and to a zero-lift setpoint; and a valve phase varying mechanism arranged to vary an exhaust valve phase of the internal combustion engine; and the control apparatus comprises a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes:

a first operation of setting the intake valve lift to the zero-lift setpoint by the valve lift varying mechanism; and a second operation of setting the exhaust valve phase by the valve phase varying mechanism so as to set an exhaust valve opening timing of the internal combustion engine to a first timing setpoint on an advance side of bottom dead center and set an exhaust valve closing timing of the internal combustion engine to a second timing setpoint on a retard side of bottom dead center, wherein the first and second timing setpoints are closer to top dead center than to bottom dead center.

2. The control apparatus as claimed in claim 1, wherein the first timing setpoint is substantially as close to bottom dead center as the second timing setpoint.

3. The control apparatus as claimed in claim 1, wherein the first timing setpoint is closer to bottom dead center than the second timing setpoint.

4. The control apparatus as claimed in claim 1, wherein the controller is configured to:

set the first timing setpoint substantially as close to bottom dead center as the second timing setpoint in response to determination that the internal combustion engine is rotating below a predetermined speed setpoint; and set the first timing setpoint closer to bottom dead center than the second timing setpoint in response to determination that the internal combustion engine is rotating above the predetermined speed setpoint.

5. The control apparatus as claimed in claim 1, wherein the controller is configured to perform the control operation for at least part of cylinders of the internal combustion engine in response to determination that a vehicle provided with the internal combustion engine is decelerating under a predetermined condition.

6. The control apparatus as claimed in claim 1, wherein the controller is configured to perform the control operation for part of cylinders of the internal combustion engine in response to determination that the internal combustion engine is operating in a predetermined low load region.

7. The control apparatus as claimed in claim 1, wherein:

a vehicle is provided with the internal combustion engine and an electric motor for driving the vehicle; and the controller is configured to perform the control operation for all cylinders of the internal combustion engine in response to determination that the internal combustion engine is operating in a predetermined low load region.

8. The control apparatus as claimed in claim 1, wherein:

a vehicle is provided with the internal combustion engine and an electric motor for producing driving torque to drive the vehicle; and the control operation includes a third operation of controlling the electric motor so as to cancel transient change in the driving torque during the control operation.

9. The control apparatus as claimed in claim 1, wherein the second operation is implemented by maximally advancing the exhaust valve phase by the valve phase varying mechanism.

10. A control apparatus for an internal combustion engine, wherein:

the internal combustion engine is provided with:

a valve lift varying mechanism arranged to vary an intake valve lift of the internal combustion engine, and set the intake valve lift at least to a non-zero lift setpoint and to a zero-lift setpoint; and a valve phase varying mechanism arranged to vary an exhaust valve phase of the internal combustion engine; and the control apparatus comprises a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes:

a first operation of setting the intake valve lift to the zero-lift setpoint by the valve lift varying mechanism; and a second operation of setting the exhaust valve phase by the valve phase varying mechanism after the first operation so as to set an exhaust valve opening timing of the internal combustion engine to a first timing setpoint on an advance side of bottom dead center and set an exhaust valve closing timing of the internal combustion engine to a second timing setpoint on a retard side of bottom dead center.

11. The control apparatus as claimed in claim 10, wherein the first timing setpoint is closer to bottom dead center than the second timing setpoint.

12. The control apparatus as claimed in claim 10, wherein the controller is configured to:

set the first timing setpoint substantially as close to bottom dead center as the second timing setpoint in response to determination that the internal combustion engine is rotating below a predetermined speed setpoint; and set the first timing setpoint closer to bottom dead center than the second timing setpoint in response to determination that the internal combustion engine is rotating above the predetermined speed setpoint.

13. The control apparatus as claimed in claim 10, wherein the controller is configured to perform the control operation for at least part of cylinders of the internal combustion engine in response to determination that a vehicle provided with the internal combustion engine is decelerating under a predetermined condition.

14. The control apparatus as claimed in claim 10, wherein:

a vehicle is provided with the internal combustion engine and an electric motor for producing driving torque to drive the vehicle; and the control operation includes a third operation of controlling the electric motor so as to cancel transient change in the driving torque during the control operation.

15. The control apparatus as claimed in claim 10, wherein the second operation is implemented by maximally advancing the exhaust valve phase by the valve phase varying mechanism.

16. A valve phase varying apparatus for an internal combustion engine, wherein:

the internal combustion engine is provided with a valve lift varying mechanism, wherein the valve lift varying mechanism is arranged to vary an intake valve lift of the internal combustion engine, and configured to set the intake valve lift to a zero-lift setpoint in response to a request to pause at least one cylinder of the internal combustion engine while the internal combustion engine is in operation; and the valve phase varying apparatus comprises a valve phase varying mechanism arranged to vary an exhaust valve phase of the internal combustion engine, wherein the valve phase varying mechanism allows the exhaust valve phase to be set so as to set an exhaust valve opening timing of the internal combustion engine to a first timing setpoint on an advance side of bottom dead center and set an exhaust valve closing timing of the internal combustion engine to a second timing setpoint on a retard side of bottom dead center, wherein the first and second timing setpoints are closer to top dead center than to bottom dead center.

17. The valve phase varying apparatus as claimed in claim 16, wherein the exhaust valve opening timing is at the first timing setpoint and the exhaust valve closing timing is at the second timing setpoint when the exhaust valve phase is at a maximally advanced setpoint allowed by the valve phase varying mechanism.

18. The valve phase varying apparatus as claimed in claim 17, wherein the valve phase varying mechanism is arranged to stabilize the exhaust valve phase at a setpoint on a retard side of the maximally advanced setpoint when the valve phase varying mechanism is in non-driven state.

19. A variable valve actuating apparatus for an internal combustion engine, comprising:

a valve lift varying mechanism arranged to vary an intake valve lift of the internal combustion engine, and set the intake valve lift at least to a non-zero lift setpoint and to a zero-lift setpoint;

a valve phase varying mechanism arranged to vary an exhaust valve phase of the internal combustion engine; and a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes:

a first operation of setting the intake valve lift to the zero-lift setpoint by the valve lift varying mechanism; and a second operation of setting the exhaust valve phase by the valve phase varying mechanism so as to set an exhaust valve opening timing of the internal combustion engine to a first timing setpoint on an advance side of bottom dead center and set an exhaust valve closing timing of the internal combustion engine to a second timing setpoint on a retard side of bottom dead center, wherein the first and second timing setpoints are closer to top dead center than to bottom dead center.

20. The variable valve actuating apparatus as claimed in claim 19, wherein the valve lift varying mechanism is arranged to stabilize the intake valve lift at the non-zero lift setpoint when the valve lift varying mechanism is in non-driven state.

21. A variable valve actuating apparatus for an internal combustion engine, comprising:

a valve lift varying mechanism arranged to vary an intake valve lift of the internal combustion engine, and set the intake valve lift at least to a non-zero lift setpoint and to a zero-lift setpoint;

a valve phase varying mechanism arranged to vary an exhaust valve phase of the internal combustion engine; and a controller adapted to be connected for signal communication therewith to the valve lift varying mechanism and the valve phase varying mechanism, wherein the controller is configured to perform a control operation in response to a request to pause at least one cylinder of the internal combustion engine while the internal combustion engine is in operation, wherein the control operation includes:

a first operation of setting the intake valve lift to the zero-lift setpoint by the valve lift varying mechanism; and a second operation of setting the exhaust valve phase by the valve phase varying mechanism after the first operation so as to set an exhaust valve opening timing of the internal combustion engine to a first timing setpoint on an advance side of bottom dead center and set an exhaust valve closing timing of the internal combustion engine to a second timing setpoint on a retard side of bottom dead center.

* * * * *